US012503851B2

(12) United States Patent
Molony et al.

(10) Patent No.: US 12,503,851 B2
(45) Date of Patent: Dec. 23, 2025

(54) BUILDING SURFACE SYSTEM INCLUDING VERTICAL RAILS, AND METHOD OF ASSEMBLY

(71) Applicant: CertainTeed Gypsum, Inc., Malvern, PA (US)

(72) Inventors: Evan Molony, Northborough, MA (US); William Lentlie, Worcester, MA (US); Aaron Bruckerhoff, Medfield, MA (US); Kallie Gray Mingay, Somerville, MA (US)

(73) Assignee: CertainTeed Gypsum, Inc., Malvern, PA (US)

( * ) Notice: Subject to any disclaimer, the term of this patent is extended or adjusted under 35 U.S.C. 154(b) by 344 days.

(21) Appl. No.: 18/173,163

(22) Filed: Feb. 23, 2023

(65) Prior Publication Data

US 2023/0265651 A1 Aug. 24, 2023

Related U.S. Application Data

(60) Provisional application No. 63/313,135, filed on Feb. 23, 2022.

(51) Int. Cl.
*E04B 2/74* (2006.01)
*E04B 2/02* (2006.01)

(52) U.S. Cl.
CPC .... *E04B 2/7453* (2013.01); *E04B 2002/0245* (2013.01)

(58) Field of Classification Search
CPC ..... E04B 2/7453; E04B 2002/0245; E04B 2002/7474; E04B 2002/7477; E04F 13/083; E04F 13/14; E04F 13/0816
See application file for complete search history.

(56) References Cited

U.S. PATENT DOCUMENTS 3,444,657 A 5/1969 Swanson
3,576,091 A 4/1971 Smith
(Continued)

FOREIGN PATENT DOCUMENTS

CA 995871 A 8/1976
CA 1329690 C 5/1994
(Continued)

*Primary Examiner* — Patrick J Maestri
(74) *Attorney, Agent, or Firm* — McDonnell Boehnen Hulbert & Berghoff LLP

(57) ABSTRACT

The present disclosure relates generally to building surface systems, for example, suitable for forming an internal or external surface of a building. The present disclosure relates more particularly to a building surface system including a support structure and a plurality of building surface products attached to the support structure. The support structure includes a first vertical rail that has a longitudinal section and a vertical receiving slot in the longitudinal section. A first building surface product includes a panel and a first attachment post extending outward from a rear surface of the panel. The first attachment post includes a shaft that extends through the vertical receiving slot of the first vertical rail such that the longitudinal section of the first vertical rail is clamped between a head of the first attachment post and the rear surface of the panel so as to secure the first building surface product against the support structure.

20 Claims, 13 Drawing Sheets

(56) References Cited

U.S. PATENT DOCUMENTS

| | | | | |
|---|---|---|---|---|
| 3,733,755 | A | 5/1973 | Bulter | |
| 3,741,843 | A | 6/1973 | Louis | |
| 4,157,271 | A | 6/1979 | Moore | |
| 4,313,991 | A | 2/1982 | Lamb | |
| 4,709,514 | A | 12/1987 | Mitchell | |
| 5,333,433 | A | 8/1994 | Porambo | |
| 6,202,377 | B1 | 3/2001 | Krieger | |
| 6,226,957 | B1 | 5/2001 | Slough | |
| 6,413,606 | B1 | 7/2002 | Calderon | |
| 6,951,087 | B2 | 10/2005 | Weurman | |
| 7,191,570 | B1 | 3/2007 | Eaton | |
| 8,429,866 | B2 | 4/2013 | Knight | |
| 8,707,648 | B2 | 4/2014 | Timko | |
| 8,871,326 | B2 | 10/2014 | Flennert | |
| 9,063,858 | B2 | 6/2015 | Macdonald | |
| 9,080,331 | B2 | 7/2015 | Aboukhailil | |
| 10,208,476 | B2 | 2/2019 | Van Rijsingen | |
| 2001/0011443 | A1* | 8/2001 | Watanabe | E04F 13/0816 52/235 |
| 2004/0071933 | A1 | 4/2004 | McConnell et al. | |
| 2005/0193666 | A1 | 9/2005 | McConnell | |
| 2006/0070331 | A1 | 4/2006 | Yakobics | |
| 2009/0077922 | A1 | 3/2009 | Pettine | |
| 2009/0084055 | A1 | 4/2009 | Mangiardi | |
| 2009/0241444 | A1 | 10/2009 | Griffiths | |
| 2011/0192519 | A1 | 8/2011 | Gangl | |
| 2012/0311946 | A1* | 12/2012 | Liu | E04B 2/7425 52/239 |
| 2014/0311064 | A1 | 10/2014 | Beaty | |
| 2016/0201325 | A1 | 7/2016 | Moore | |
| 2018/0073246 | A1 | 3/2018 | Ullett | |
| 2018/0283002 | A1 | 10/2018 | Tanguay | |
| 2021/0017764 | A1 | 1/2021 | Jenkins | |
| 2022/0064961 | A1* | 3/2022 | Briggs | E04F 13/14 |

FOREIGN PATENT DOCUMENTS

| | | | | |
|---|---|---|---|---|
| CA | 3051808 | A1 | 9/2018 | |
| CN | 201310169 | Y | 9/2009 | |
| CN | 103924762 | A | 7/2014 | |
| CN | 204001571 | U | 12/2014 | |
| CN | 204040216 | U | 12/2014 | |
| CN | 104831895 | A | 8/2015 | |
| CN | 105308246 | A | 2/2016 | |
| DE | 202010005397 | U1 | 7/2010 | |
| DE | 102018008489 | A1 | 5/2019 | |
| JP | H0932195 | A | 2/1997 | |
| JP | 2017-197936 | A | 11/2017 | |
| JP | 2019-085733 | A | 6/2019 | |
| WO | 2012152994 | A1 | 11/2012 | |
| WO | 2015057732 | A1 | 11/2016 | |
| WO | WO-2019034923 | A1 * | 2/2019 | E04F 13/0835 |

* cited by examiner

BUILDING SURFACE SYSTEM INCLUDING VERTICAL RAILS, AND METHOD OF ASSEMBLY

CROSS-REFERENCE TO RELATED APPLICATIONS

This application claims the benefit of priority of U.S. Provisional Patent Application No. 63/313,135, filed Feb. 23, 2023, which is hereby incorporated herein by reference in its entirety.

BACKGROUND OF THE DISCLOSURE

1. Field of the Disclosure

The present disclosure relates generally to building surface systems, for example, suitable for forming an internal or external surface of a building. The present disclosure relates more particularly to a building surface system formed by panels that are secured to a support structure.

2. Technical Background

Prefabricated panels, for example gypsum panels that are commonly referred to as drywall, are often used to construct building surfaces. The panels are attached to a supporting structure, such as the joists of a wall frame. Once the panels are hung on the supporting structure, the surface is finished using joint compound or another material to create a smooth surface. The surface may then be painted or covered with wall paper.

Gypsum panels are advantageous for use as a building surface for various reasons. Such panels are incredibly durable, have excellent fire resistance, are easily repaired, and are easy to mount on a supporting structure. Typically, mounting gypsum panels only requires attaching the panels to an underlying supporting structure using mechanical fasteners, such as screws.

While the mounting of gypsum panels is relatively straightforward, most panels are finished by covering the joints between the panels and the fasteners in order to create a smooth surface. The panels are then painted or covered with wall paper to create a pleasing aesthetic. The process of finishing the building surface is time consuming, as each application of joint compound or paint should be dried before the subsequent step can be performed. Moreover, the finishing steps require uncommon skills.

For the foregoing reasons, the present inventors have determined that a building surface product that can be installed more quickly would be attractive to both builders and customers.

SUMMARY OF THE DISCLOSURE

In one aspect, the present disclosure provides a building surface system comprising:

a support structure including a plurality of vertical rails that form a support surface, wherein the plurality of rails comprises a first vertical rail including a longitudinal section and a vertical receiving slot in the longitudinal section; and a plurality of building surface products attached to the support structure, wherein the plurality of building surface products comprises a first building surface product including:

a substantially planar panel having a first side, a second side, a first end, a second end, a front surface, a rear surface, and a gypsum body between the front surface and rear surface, and a first attachment post extending outward from the rear surface of the panel, the first attachment post including a shaft that penetrates the rear surface of the panel and a head that extends radially outward from the shaft at a distance from the rear surface of the panel, wherein the distance between the head and the rear surface of the panel is adjustable wherein the shaft of the first attachment post of the first building surface product extends through the vertical receiving slot of the first vertical rail and the longitudinal section of the first vertical rail is clamped between the head of the first attachment post and the rear surface of the panel so as to secure the first building surface product against the support structure.

In another aspect, the disclosure provides a method of forming the building surface system according to the disclosure, the method comprising:

positioning the first building surface product in front of the support structure such that the rear surface of the panel of the first building surface product faces the support structure, a shaft of the first attachment post extends through the vertical receiving slot of the longitudinal section of the first vertical rail, and the head of the first attachment post is positioned behind the first vertical rail; and securing the first building surface product to the support structure by reducing the distance between the head of the first attachment post and the rear surface of the panel so as to clamp the first vertical rail between the head of the first attachment post and the rear surface of the panel.

Additional aspects of the disclosure will be evident from the disclosure herein.

BRIEF DESCRIPTION OF THE DRAWINGS

The accompanying drawings are included to provide a further understanding of the methods and devices of the disclosure, and are incorporated in and constitute a part of this specification. The drawings are not necessarily to scale, and sizes of various elements may be distorted for clarity. The drawings illustrate one or more embodiment(s) of the disclosure, and together with the description serve to explain the principles and operation of the disclosure.

DETAILED DESCRIPTION

As described above, the present inventors have noted that conventional building surface products are time-consuming to install and require skill to finish. The present inventors have determined that a building surface system that can be installed more quickly and without requiring specific skills to finish would be attractive to builders and customers.

Accordingly, one aspect of the disclosure is a building surface system including a support structure and a plurality of building surface products attached to the support structure. The support structure includes a plurality of vertical rails that form a support surface. The plurality of vertical rails includes a first vertical rail that has a longitudinal section and a vertical receiving slot in the longitudinal section. The plurality of building surface products includes a first building surface product with a substantially planar panel having a first side, a second side, a first end, a second end, a front surface, a rear surface, and a gypsum body between the front surface and rear surface. A first attachment post extends outward from the rear surface of the panel. The first attachment post includes a shaft that penetrates the rear surface of the panel and a head that extends radially outward from the shaft at a distance from the rear surface of the panel. The distance between the head and the rear surface of the panel is adjustable. The shaft of the first attachment post of the first building surface product extends through the vertical receiving slot of the first vertical rail and the longitudinal section of the first vertical rail is clamped between the head of the first attachment post and the rear surface of the panel so as to secure the first building surface product against the support structure.

Figure 1A:
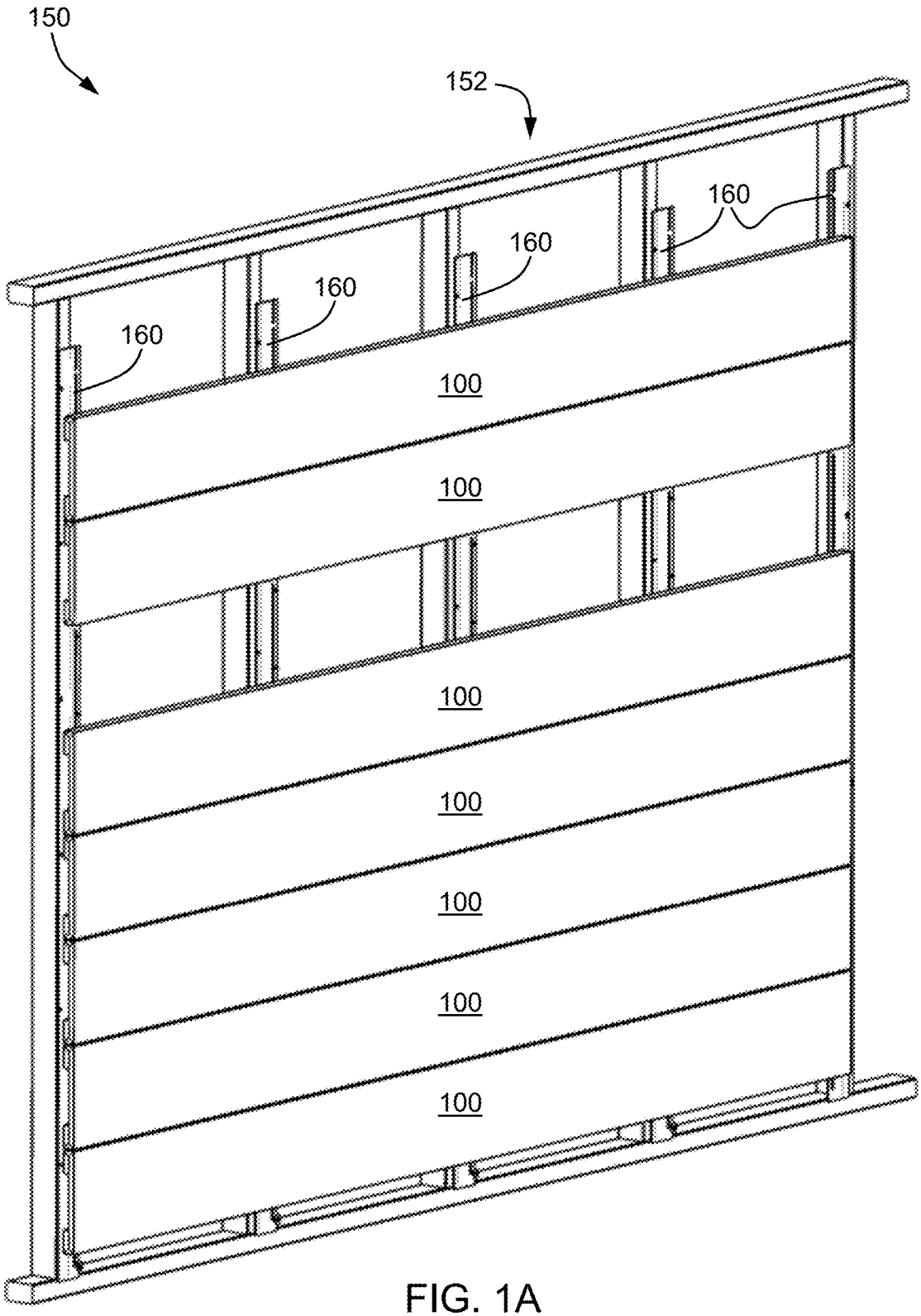
FIG. 1A is a schematic perspective front view of a building surface system according to an embodiment of the disclosure.
Figure 1B:
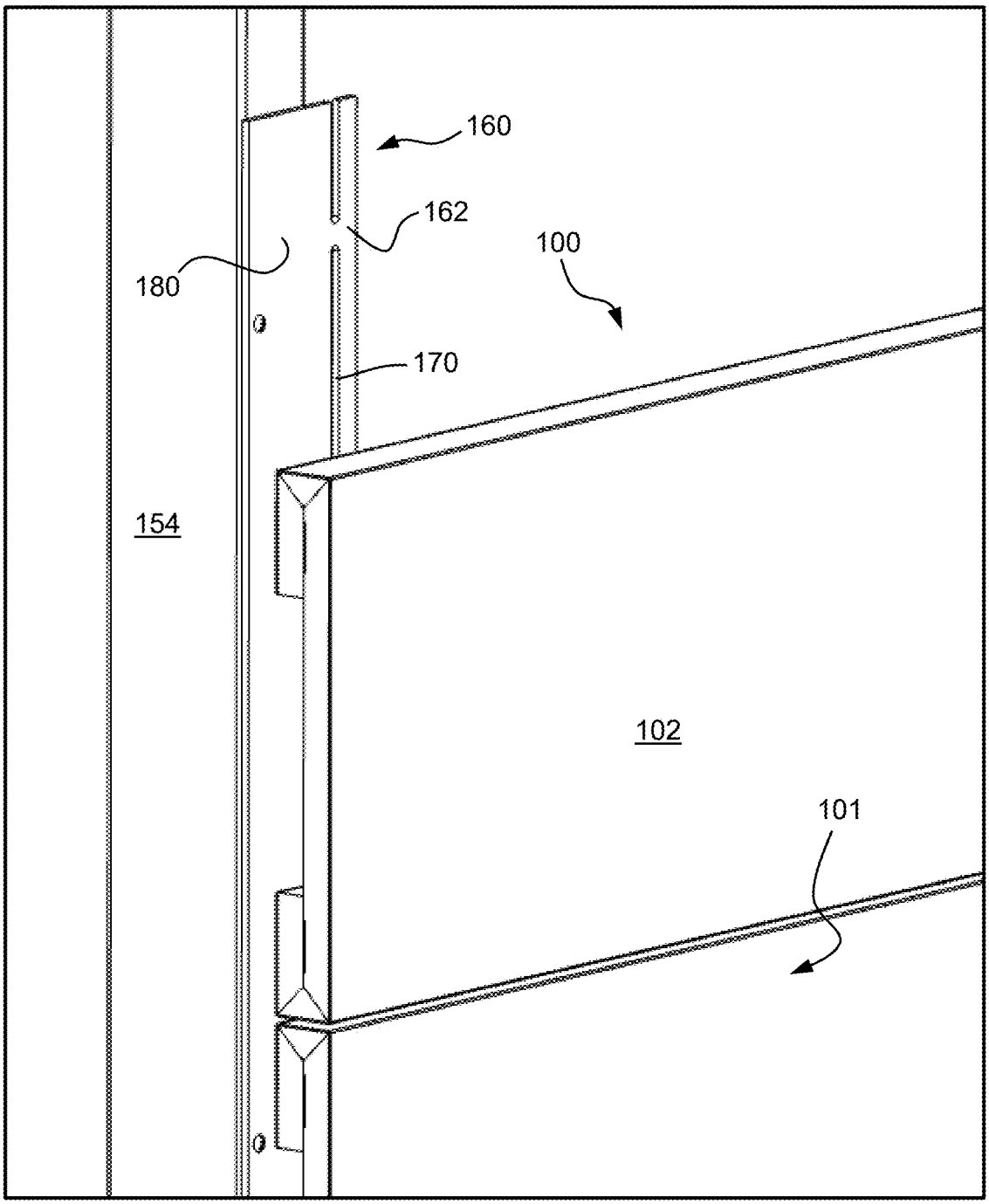
FIG. 1B is a schematic perspective front view of a portion of the building surface system of FIG. 1A.
Figure 1C:
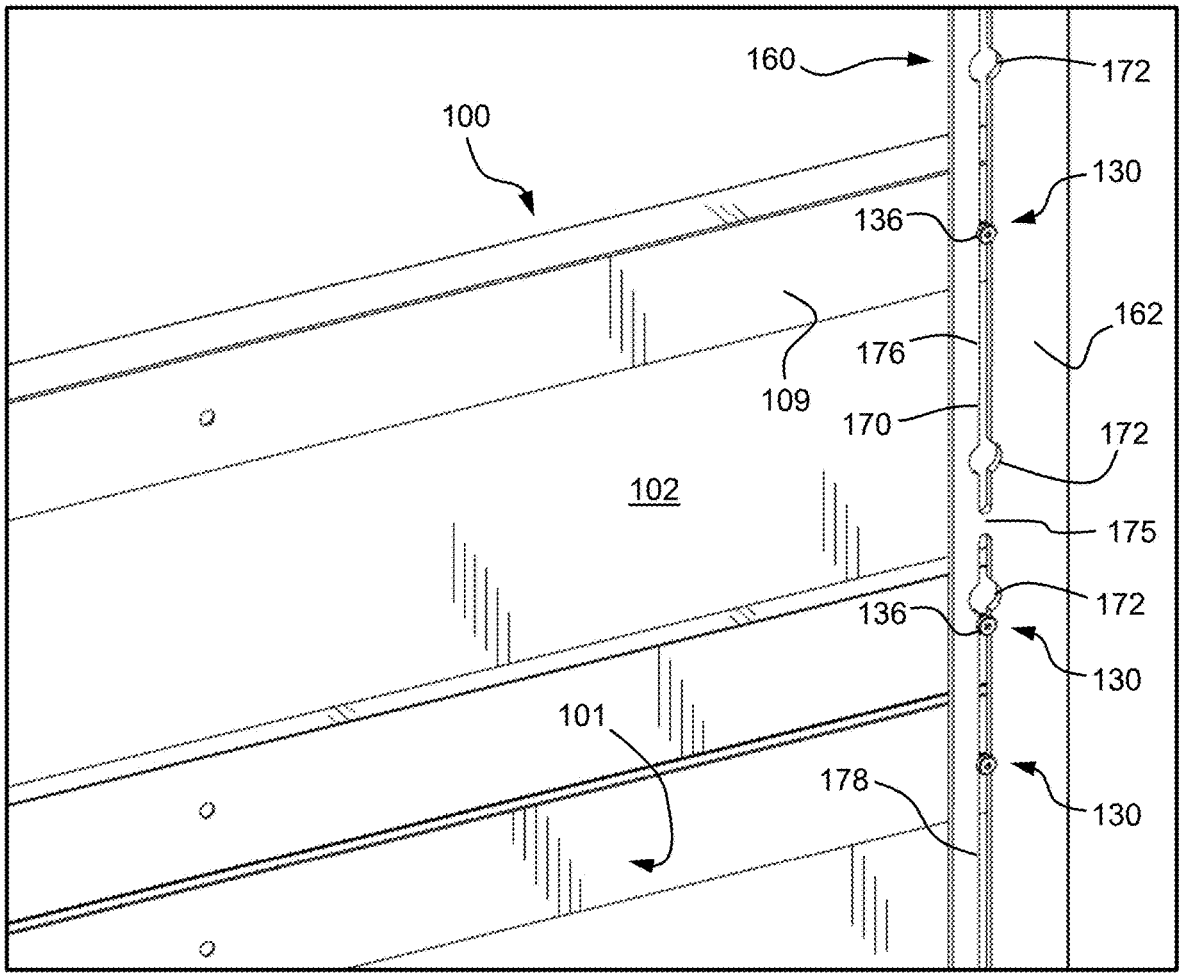
FIG. 1C is a schematic perspective rear view of a portion of the building surface system of FIG. 1A.

Such a system is shown, for example, in FIGS. 1A-1E. As shown in FIG. 1A, building surface system 150 includes a support structure 152 and a plurality of building surface products 100 attached to support structure 152. The support structure 152 includes a plurality of vertical rails 160 that form a support surface. As shown more clearly in FIGS. 1B and 1C, each of the vertical rails 160 of the support structure includes a longitudinal section 162 with a vertical receiving slot 170. Further, as shown in FIG. 1C, each of the illustrated building surface products 100 includes a panel 102 that is held to vertical rails 160 of the support structure using attachment posts 130 that extend outward from a rear surface 109 of the panel 102. For example, FIG. 1C shows a pair of attachment posts 130 extending through vertical receiving slot 170 in order to secure building surface product 100 to the support structure 152. The depth that the attachment posts 130 extend into panel 102 can be varied in order to clamp longitudinal section 162 of vertical rail 160 between a head 136 of the attachment post 130 and rear surface 109 of the panel 102 in order to secure the building surface product 100 in place.

Figure 1D:
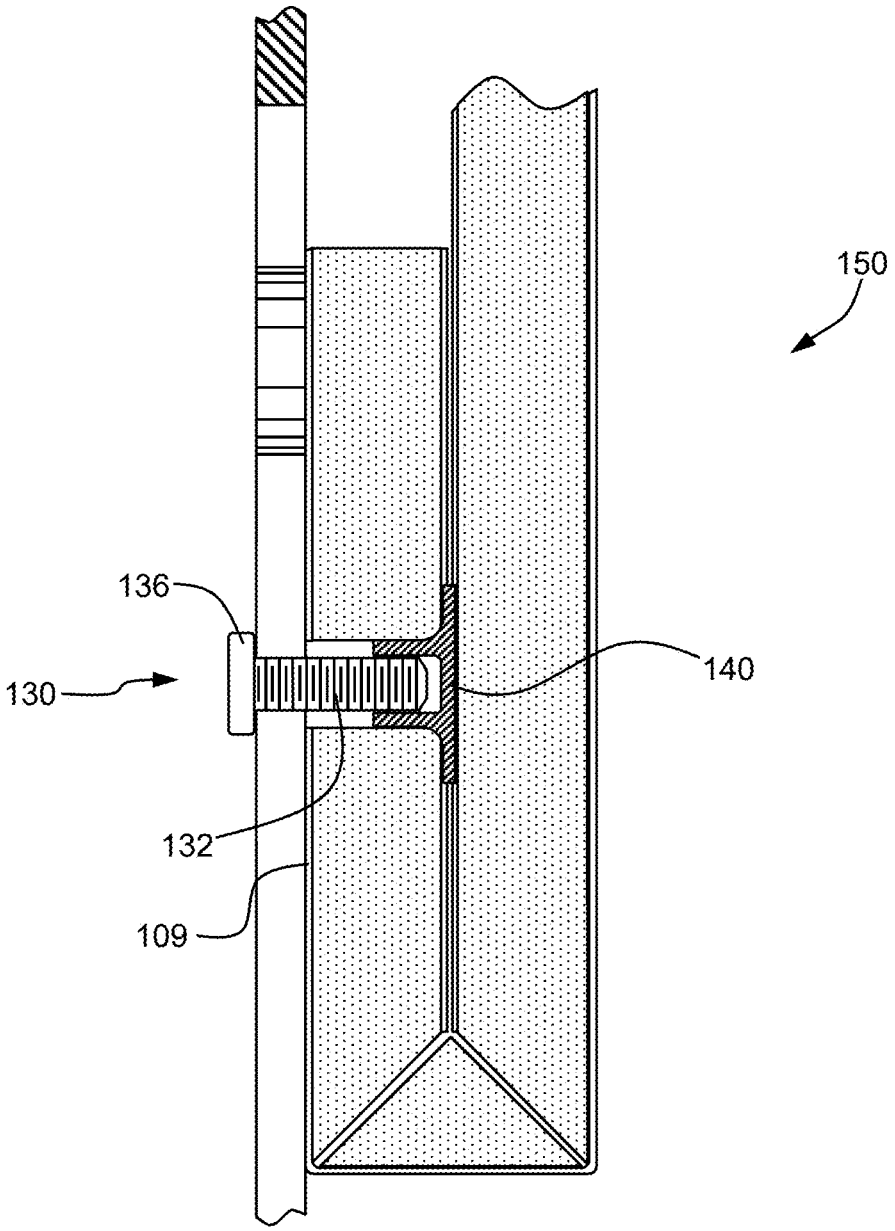
FIG. 1D is a schematic cross-sectional view of a portion of the building surface system of FIG. 1A.

For example, FIG. 1D shows a cross section of a portion of a building surface product 100 secured to a vertical rail 160 using an attachment post 130. As shown, the attachment post 130 extends outward from the rear surface 109 of the panel 102 of building surface product 100. The attachment post 130 includes a shaft 132 that penetrates the rear surface 109 of the panel 102 and a head 136 that extends radially outward from the shaft 132 at a distance from the rear surface 109 of the panel 102. The distance between the head 136 and the rear surface 109 of the panel 102 is adjustable, for example, using threads as explained in further detail below.

In order to secure the building surface product 100 in place, the shaft 132 of the attachment post 130 of the first building surface product 100 extends through the vertical receiving slot 170 of the vertical rail 160 such that the head 136 of the attachment post 130 and the panel 102 are positioned on opposing sides of the vertical rail 160. To secure the building surface product 100 in place on the vertical rail 160, the distance between the head 136 of the attachment post 130 and the panel 102 may be reduced to clamp the longitudinal section 162 of the vertical rail 160 between the head 136 of the attachment post 130 and the panel 102.

Figure 1E:
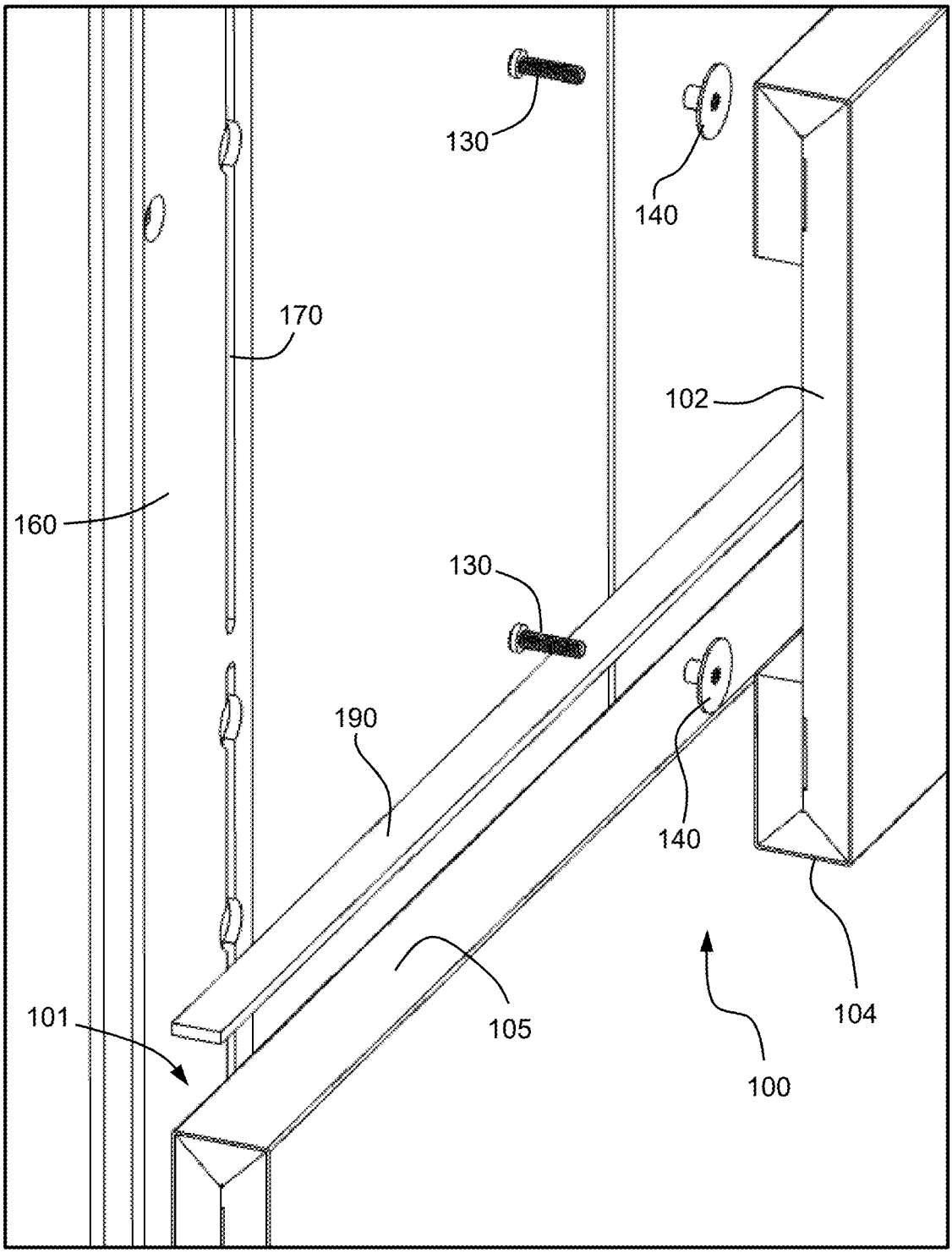
FIG. 1E is a schematic exploded perspective view of a portion of the building surface system of FIG. 1A.

FIG. 1E shows an exploded view of a portion of building surface system 150, as explained in more detail below. In this exploded view, two attachment posts 130 are removed from panel 102 and from the vertical receiving slot 170 of vertical rail 160.

The head of the attachment posts may have various different forms. As stated above, the head extends radially outward from the shaft which provides the head with a surface to engage the vertical rail. In some embodiments, the head extends radially outward from the shaft in all directions about the circumference of the shaft. For example, in some embodiments, the head is wider than the shaft in all directions about the axis of the shaft, similar to the head of a bolt. In such an embodiment, the head may engage the vertical rail on both sides of the vertical slot, regardless of the rotational position of the attachment post. In other embodiments, the head extends radially from the shaft in particular directions about the axis of the shaft. For example, in some embodiments the head extends in two opposing directions such that the attachment post has a T-shape. Further, in some embodiments the head extends in a single direction about the shaft of the axis such that the attachment post has an L-shape.

In building surface system 150, the head 136 of the attachment post 130 has a circular shape. In other embodiments, the head of the attachment post has another shape, such as a square, hexagon or other polygonal shape. Such a shape may allow the external surface of the head to be secured in a tool, such as a wrench. Further, in some embodiments, the head of the attachment includes a socket (e.g., Phillips, hex, Torx, star, jis, etc.) or slot for receiving a tool, such as a screw driver or hex key. Further still, in some embodiments, the outer surface of the head of the attachment post is textured, such as knurled, to allow for rotating the head.

The attachment posts may be secured to the panel in a variety of different manners, as explained further below. In building surface assembly 150, for example, the building surface product 100 includes receiver sleeves 140 that are secured in the panel 102, as shown in FIG. 1D. The receiver sleeves 140 are configured to receive the attachment posts 130 and hold the attachment post 130 in the panel, for example, using threads. The receiver sleeves 140 are also visible in the exploded view of FIG. 1E, for clarity. Further details about embodiments of receiver sleeves are described below.

Figure 2A:
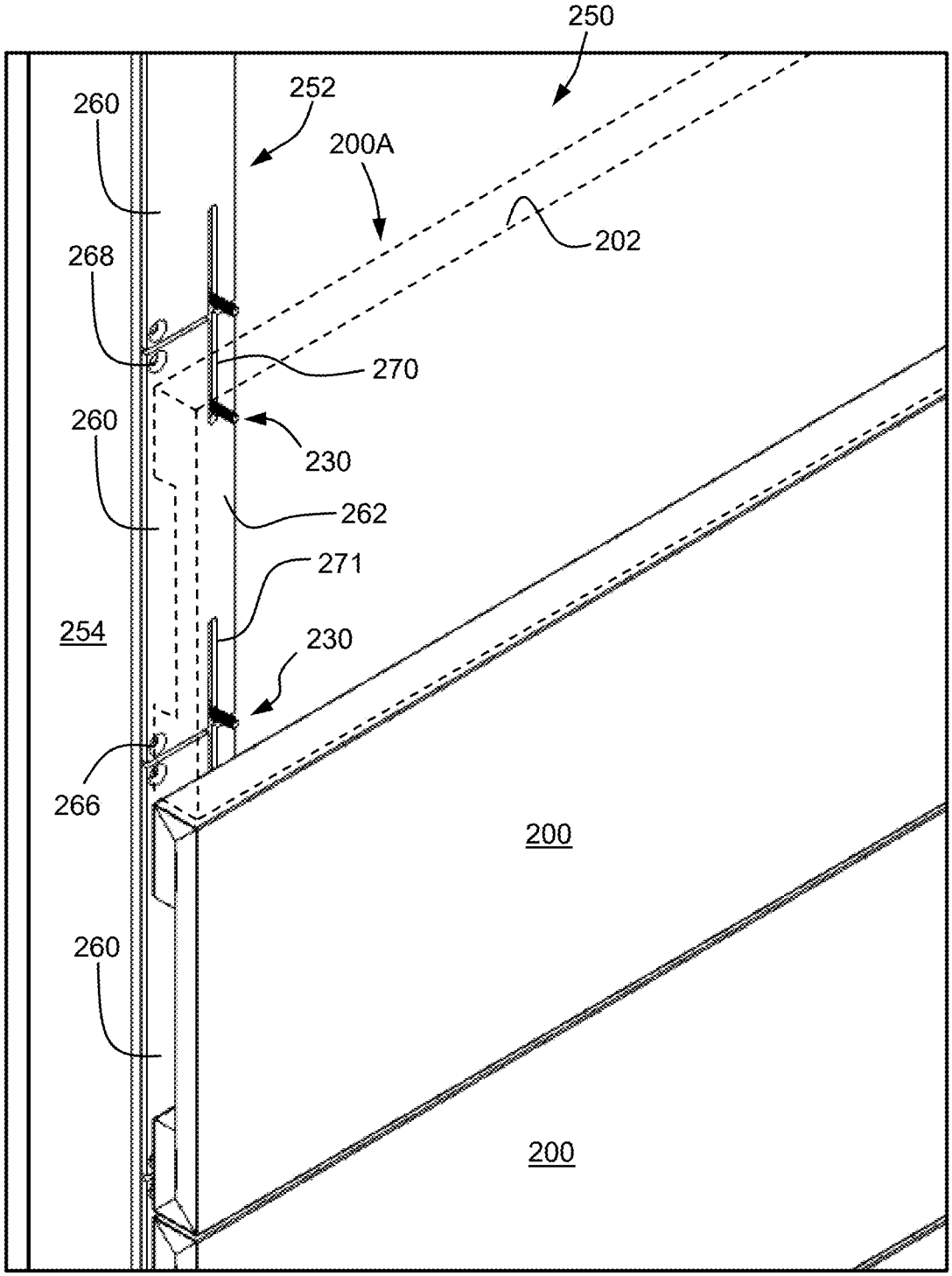
FIG. 2A is a schematic front view of a portion of a building surface system according to another embodiment of the disclosure.
Figure 2B:
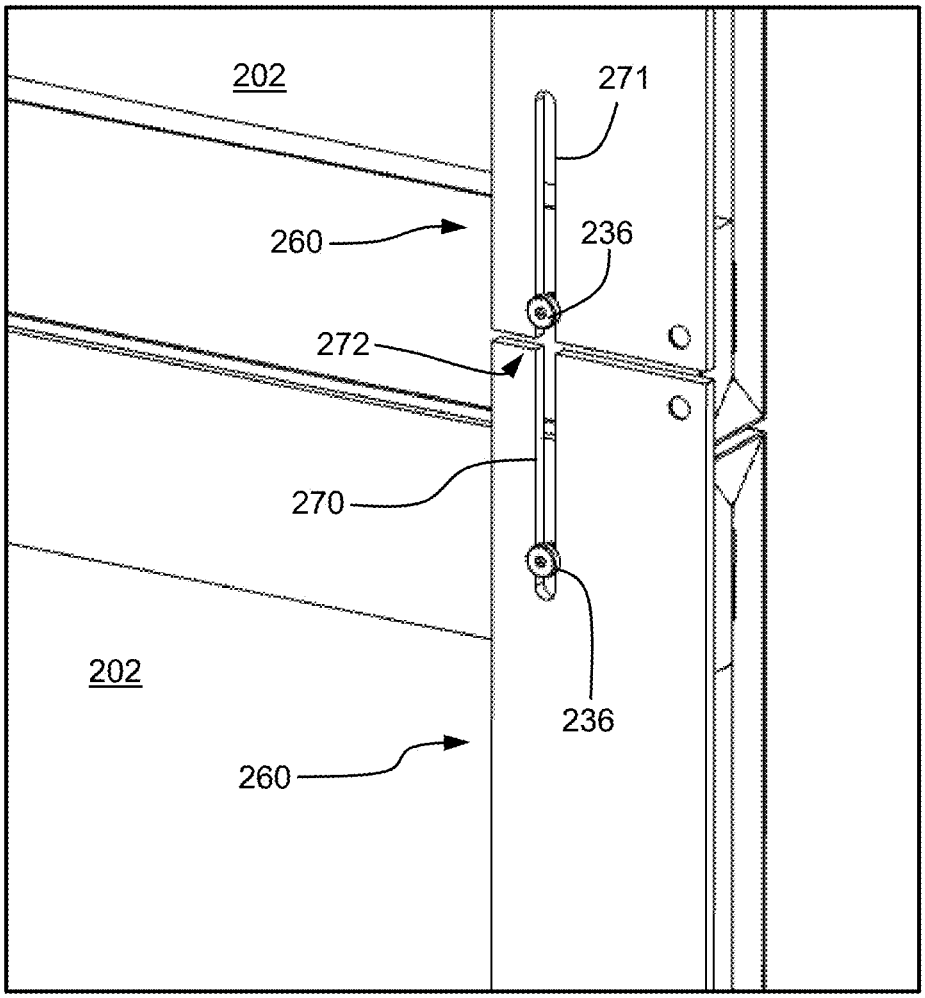
FIG. 2B is a schematic rear view of a portion of the building surface system according to FIG. 2A.

FIGS. 2A and 2B show a portion of another embodiment of a building surface system 250 in accordance with the disclosure. Building surface system 250 includes a support structure 252 and a plurality of building surface products 200, 200A attached to the support structure 252. The panel 202 of one of the building surface products 200A is transparent and shown using dashed lines for clarity. The support structure 252 includes a plurality of vertical rails 260 each of which includes a longitudinal section 262 that has an upper vertical receiving slot 270 and a lower vertical receiving slot 271. As shown with respect to building surface product 200A, the building surface products include a panel 202 and attachment posts 230 that extend outward from a rear surface of the panel 202. The attachment posts 230 extend through the vertical receiving slots 270, 271. Accordingly, as shown in FIG. 2B, the heads 236 of the attachment posts are positioned opposite the panels 202 of the building surface products so that the vertical rails 260 may be clamped between the panels 202 and the heads 236 of the attachment posts in a manner similar to that explained above with respect to building surface system 150.

In certain embodiments of the building surface system as otherwise described herein, the shaft of the first attachment post is unsupported by the first vertical rail. For example, as shown in FIG. 1C, the attachment posts 130 of building surface product 100 are disposed within an area of vertical receiving slot 170 that is spaced from the bottom of the slot 170 or an open segment of the slot. Accordingly, the shaft of the attachment post 130 is not supported by the material of the vertical rail 160. In other words, the opening of the slot continues in the area immediately below the attachment post 130. Thus, in order to hold the building surface product 100 in place, the vertical rail 160 is clamped between the head of the attachment post 130 and the panel 102. Using such a clamping arrangement to hold the building surface product 100 in place on the vertical rail 160 allows for flexibility in the vertical positioning of the building surface product 100. Accordingly, the building surface product 100 can be positioned on the vertical rail at a desired location irrespective of the precise geometry of the rail itself.

In certain embodiments of the building surface system as otherwise described herein, the vertical receiving slot intersects a first opening, and the first attachment post is insertable into the vertical receiving slot through the first opening. For example, in some embodiments, the first opening is formed as an aperture in the longitudinal section of the first rail, and the aperture has a width that is greater than a width of the vertical receiving slot. For example, as shown in FIGS. 1C and 1D, vertical rail 160 includes apertures 172 that intersects vertical receiving slot 170 and provide openings into vertical receiving slot 170. Specifically, the diameter of the apertures 172 is greater than both the width of vertical receiving slot 170 and the width of head 136 of attachment post 130. Accordingly, the attachment posts 130 can be inserted into vertical receiving slot 170 through the opening provided by aperture 172 after they have been secured to panel 102.

In certain embodiments of the building surface system as otherwise described herein, the first building surface product includes a second attachment post extending outward from the rear surface of the panel, the vertical receiving slot intersects a second opening, and the second attachment post is insertable into the vertical receiving slot through the second opening. For example, as shown in FIG. 1C, the illustrated end of building surface product 100 includes two attachment posts 130 and vertical receiving slot 170 includes several openings 172 for receiving the attachment posts 130. In some embodiments, the openings may be positioned along the length of the vertical slot so that two openings are spaced at the same distance as two attachment posts of the building surface product. Accordingly, the two attachment posts can be simultaneously inserted into the vertical slot through the two openings.

In some embodiments, the centers of the apertures are aligned with the center-line of the vertical slot, so that the opening extends outward on either side of the vertical slot, such as in vertical rail 160, as shown in FIG. 1C. In other embodiments, the apertures are asymmetrically positioned on one side of the vertical slot. Further, while the apertures of vertical rail 160 are circular, in other embodiments, the apertures may have other shapes, such as rectangular, triangular, or another shape.

In other embodiments, the first opening is formed at an edge of the first vertical rail. For example, as shown in FIG. 2B, vertical rail 260 of building surface system 250 includes an upper vertical slot 270 that extends to the upper edge of the vertical rail 260 so as to form an opening 272 to the upper slot 270 at the upper edge. The lower slot 271 of the adjacent vertical rail has a similar opening. The respective upper and lower slots of neighboring vertical rails are positioned in a line so that the respective openings to the slots are aligned and adjacent to one another, as shown in FIG. 2B.

In certain embodiments of the building surface system as otherwise described herein, the support structure includes a plurality of framing members including a first framing member, and the first vertical rail includes a mounting section attached to the first framing member. For example, as shown in FIG. 1A, support structure 152 of building surface system 150 includes a plurality of vertical framing members 154 in the form of beams or studs that extend in a row to provide support structure 152 with a planar configuration. As shown in FIG. 1B, each of the vertical rails 160 includes a mounting section 180 that is adjacent to the longitudinal section 162 and is attached to a respective one of the framing members 154. The longitudinal section 16 2 extends outward from the framing member 154 so that an attachment post can extend through the vertical slot without interfering with the framing member 154. In some embodiments, the mounting section runs over the length of the vertical rail alongside the longitudinal section, such as in vertical rail 160. In other embodiments, the mounting section extends over only a portion of the length of the vertical rail. For example, in some embodiments, the mounting section is formed one or more tabs that extend outward from the longitudinal section.

In some embodiments, the support structure includes framing members that are formed of timber, such as wood studs. In other embodiments, the framing members are formed of metal, such as such as steel or aluminum studs. Other materials may also be used for the framing members. On the other hand, in some embodiments, the support structure does not include separate framing members that vertical rails. For example, in some embodiments, the vertical rails may be formed as structural elements that form a frame of the support structure. For example, in some embodiments, the vertical rails may be formed as metal studs that include vertical slots to receive the attachment posts.

In some embodiments the support structure includes a service channel behind the building surface panels. For example, in some embodiments, the support structure includes primary framing members that form a primary wall frame and secondary framing members positioned in front of the primary framing members to form an accessible service channel. Such a service channel may have a width of a few inches and provide space for electrical and/or mechanical components. Further, the service channel may also provide space for inserting a tool in order to tighten the attachment posts so as to clamp the vertical rails between the attachment posts and the panels of the building surface products.

In certain embodiments of the building surface system as otherwise described herein, the first vertical rail is configured as a flat plate. For example, in building surface system 150 the vertical rails 160 are formed as flat plates with the longitudinal section 162 that includes the vertical receiving slots 170 positioned along one edge of the plate and the mounting section 180 positioned along the other edge of the plate. In other embodiments, the vertical rails have another configuration. For example, in some embodiments, the vertical rail includes a structural flange extending from one side of the longitudinal section, similar to an L-bracket. Further, in some embodiments, the vertical rails include structural flanges positioned on both sides of the longitudinal section, so as to have a channel configuration. Further still, in some embodiments, the longitudinal section of the first vertical rail is offset from the mounting section, as explained in more detail below.

In some embodiments, the vertical rail is formed of a metal, such as aluminum or steel. In other embodiments, the vertical rail is formed of a polymer material, such as a reinforced polymer. Still, in other embodiments, the vertical rail is formed of another material, such as wood, bamboo or a composite material.

In certain embodiments of the building surface system as otherwise described herein, the mounting section includes an aperture and is attached to the first framing member using a fastener that extends through the aperture. For example, in some embodiments, the vertical rails are secured to the vertical framing members with screws or nails that extend directly into the body of the vertical framing members. Further, in some embodiments, the apertures in the mounting section are holes. For instance, building surface system 250, as shown in FIG. 2A, includes a vertical rail 260 that includes a lower fastener hole 266 and an upper fastener hole 268 that receive fasteners for securing the vertical rail 260 to vertical framing member 254.

Figure 3:
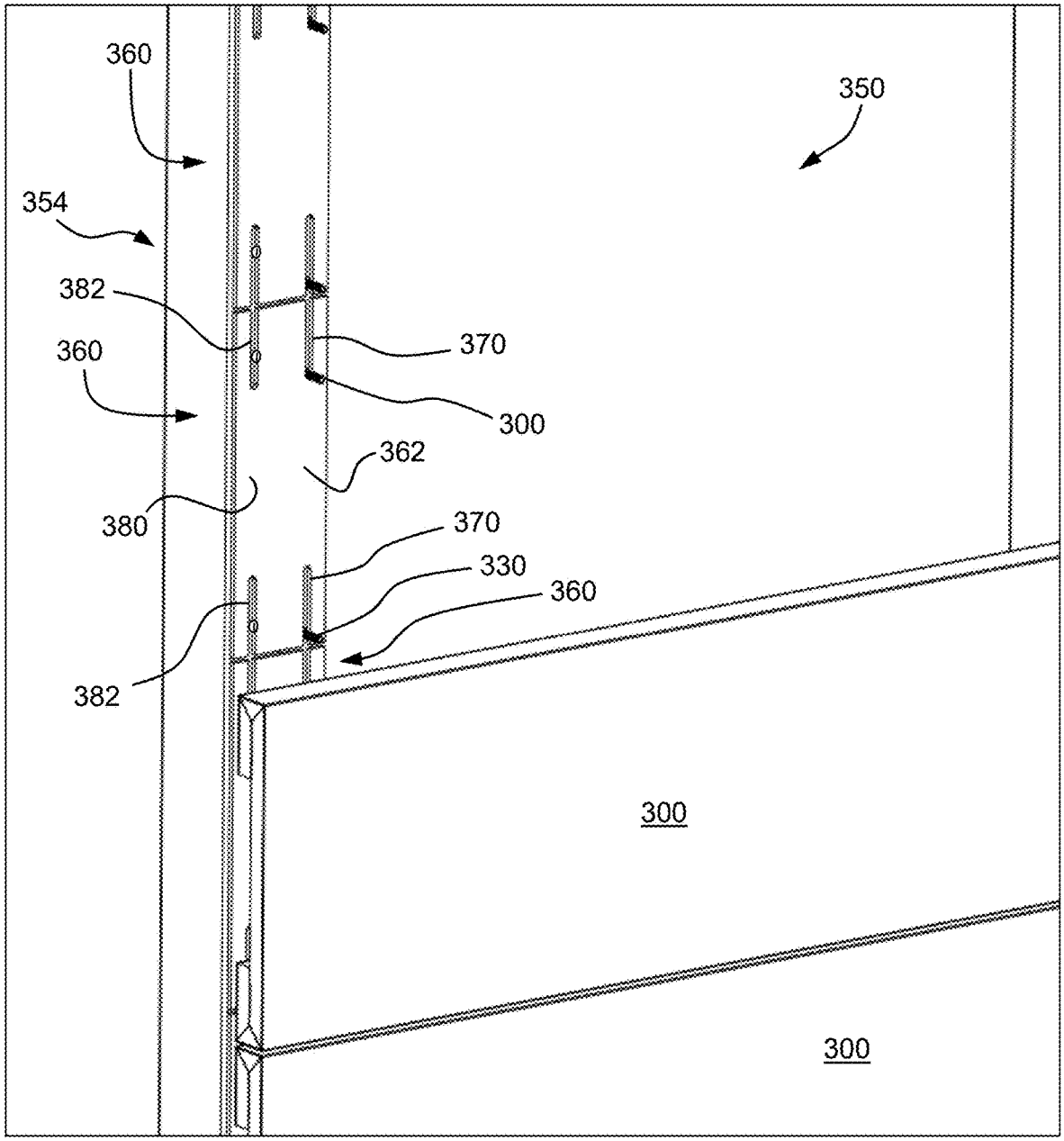
FIG. 3 is a schematic front view of a portion of a building surface system according to another embodiment of the disclosure.

In other embodiments, the apertures in the mounting section are slots. FIG. 3 shows a portion of a building surface system 350 that includes an embodiment of such a vertical rail 360. Building surface system 350 has a support structure including a framing member 354 and a plurality of vertical rails 360 secured to the framing member 354. In particular, as illustrated with respect to one of the shown vertical rails 360, each vertical rail includes a longitudinal section 362 along one edge and a mounting section 380 along the opposing edge. Vertical slots 370 are provided in the longitudinal section 362 for receiving attachment posts 330 of building surface products 300. In FIG. 3 the panels of the upper building surface products 300 have been removed for clarity. Likewise, attachment slots 382 are also provided in the mounting section 380. The attachment slots 382 are configured to receive fasteners for securing the vertical rails 360 to the framing member 354. The attachment slots may allow for greater flexibility in positioning the vertical rails. Furthermore, using slots in both the mounting section and longitudinal section of a vertical rail may simplify both manufacturing and installation, as such vertical rails may be symmetrical over various different axes.

In other embodiments, the vertical rails may be secured to the vertical framing members in another manner. For example, where the vertical framing members are metal, the vertical rails may be welded or otherwise affixed to the vertical framing members. Further still, in some embodiments, the vertical rails are secured to the vertical framing members using an adhesive.

In certain embodiments of the building surface system as otherwise described herein, the rear surface of the panel of the first building surface product abuts a front surface of the first vertical rail. For example, as shown in FIGS. 1B-1D, the rear surface 109 of panel 102 of building surface product 100 is positioned directly against the front surface of the vertical rail 160. In other embodiments an additional component is positioned between the panel and the vertical rail, such as a washer or other spacer. Further still, in some embodiments, a gap is provided between the vertical rail and the panel, for example, by arranging the panels against another component, such as the framing members, and providing the vertical rail at a position that is set back from the panel.

In certain embodiments of the building surface system as otherwise described herein, the longitudinal section of the first vertical rail forms at least a portion of the front surface of the first vertical rail. For example, as shown in FIG. 1B, vertical rail 160 is formed as a flat plate such that both the longitudinal section 162 and the mounting section 180 form the front surface of vertical rail 160 and both sections contact panel 102. In other embodiments, the vertical rail may have a bent configuration such that one of the longitudinal section or the mounting section is in front of the other. For example, in some embodiments, the vertical rail includes bends so that the longitudinal section is set back from the mounting section and the mounting section forms the front surface of the vertical rail.

Figure 4A:
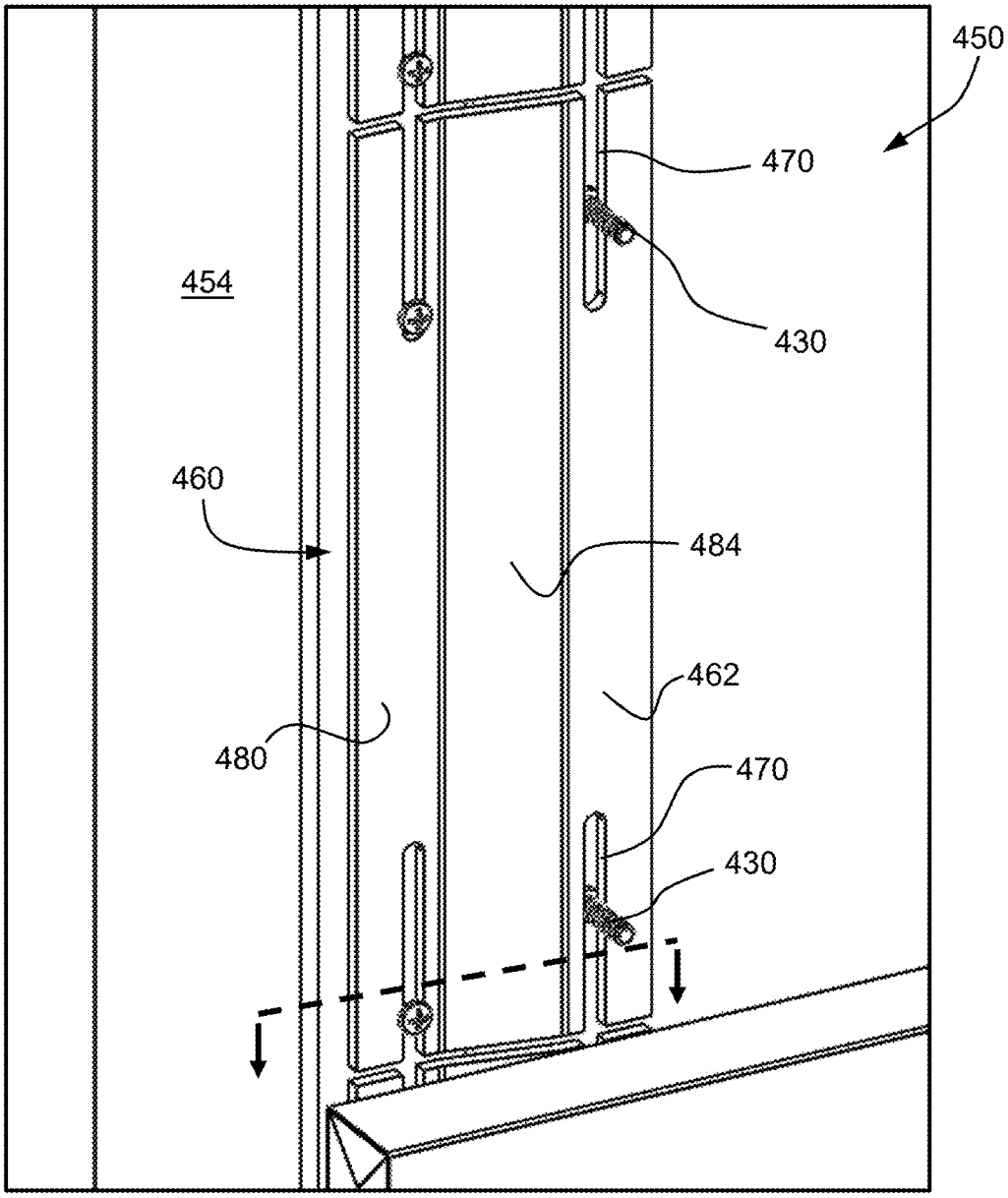
FIG. 4A is a schematic front view of a portion of a building surface system according to another embodiment of the disclosure.
Figure 4B:
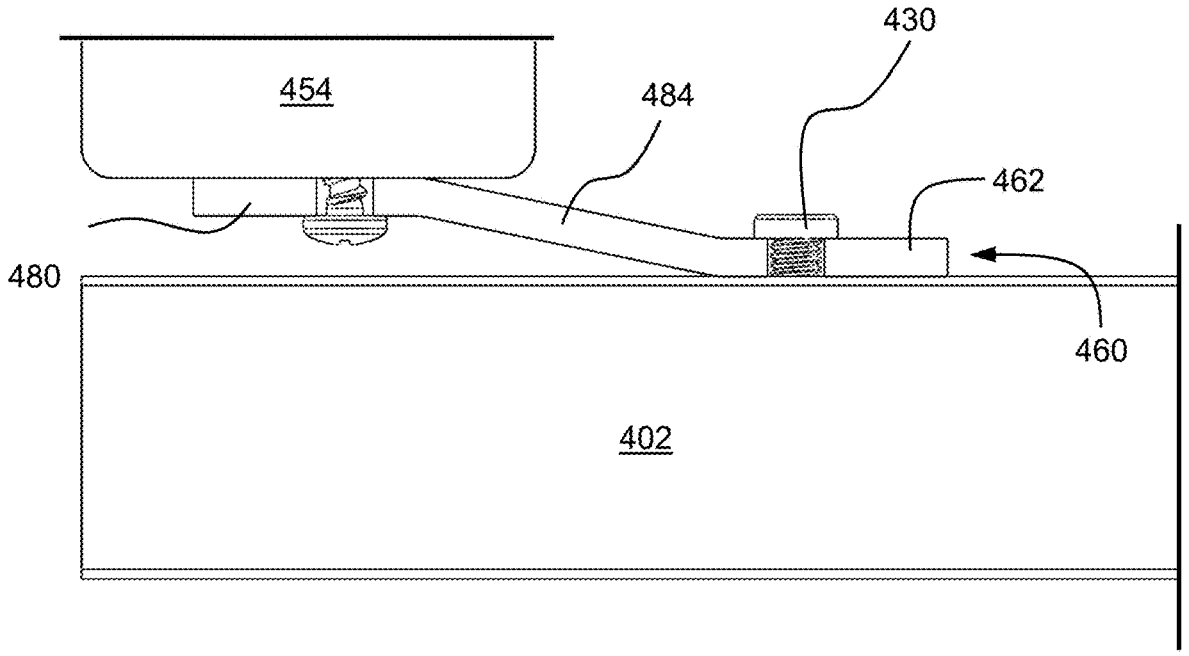
FIG. 4B is a schematic top cross-sectional view of the building surface system of FIG. 4A.

In other embodiments, the vertical rail includes bends so the mounting section is set back from the longitudinal section and the longitudinal section forms the front surface of the vertical rail. For example, a system with such a vertical rail is shown in FIGS. 4A and 4B. FIG. 4A shows a portion of a building surface system 450 that includes a vertical rail 460 mounted to a framing member 454. Vertical rail 460 includes a mounting section 480 secured to framing member 454 and a longitudinal section 462 with vertical slots 470 configured to receive attachment posts 430. The longitudinal section 462 is coupled to the mounting section 480 by an angled section 484 such that the longitudinal section 462 forms the front face of the vertical rail 460 and the mounting section 480 is set back from the longitudinal section 460. Such a configuration can provide additional room behind the panel of the building surface product for components or to ease installation. For example, as shown in FIG. 4B, the gap between the panel 402 and the mounting section 480 of vertical rail 460 provides room for the head of a fastener. Likewise, this gap can also provide additional space for inserting a tool to tighten the attachment post 430

Further still, in some embodiments, the vertical rail includes an additional section, different from the mounting section or the longitudinal section, that forms the front surface and is braced against the panel.

In certain embodiments of the building surface system as otherwise described herein, the plurality of building surface products includes a second building surface product adjacent to the first building surface product, and wherein an attachment post of the second building surface product is received in the vertical receiving slot of the longitudinal section of the first vertical rail so as to secure the second building surface product against the support structure. For example, as shown in FIGS. 1B, 1C and 1E, the illustrated building surface system includes a second building surface product 101 that is adjacent to the first building surface product 100. As shown in FIG. 1C, the second building surface product 101 is secured to the vertical rail 160 using attachment posts 130 in a manner similar to first building surface product 100, as described above.

In certain embodiments of the building surface system as otherwise described herein, the system also includes a spacer positioned between a first side of a panel of the second building surface product and the second side of the panel of the first building surface product. For example, as shown in the exploded view of FIG. 1E, a spacer 190 is configured to be placed between the lower side 104 of first building surface product 100 and the upper side of second building surface product 101. The use of similar spacers between neighboring building surface products over the height of the building surface system can provide accurate positioning of the building surface products without the need for careful measuring or relying on the geometry of the vertical rail to set the spacing.

In certain embodiments of the building surface system as otherwise described herein, the receiving slot of the first vertical rail includes a plurality of slot segments extending in a line along the longitudinal section. For example, as shown in FIG. 1C, slot 170 extends over the height of the illustrated portion of vertical rail 160, but is not continuous. Instead, a bridge of material 175 extends across slot 170 so as to separate an upper segment 176 of slot 170 from a lower segment 178. The bridge of material 175 provides structural support to the vertical rail 160.

In certain embodiments of the building surface system as otherwise described herein, the first vertical rail is one of a column of vertical rails of the plurality of vertical rails. For example, as shown in FIG. 2A, building surface system 250 includes a plurality of vertical rails 260 that are arranged in a column extending up framing member 254. The length of each vertical rail 260 of building surface system 250 is substantially equal to the height of the building surface products 200. Accordingly, as explained further below, the building surface product 200 and vertical rails 260 of building surface system 250 can be secured to the framing member 254 as an assembly.

Figure 5A:
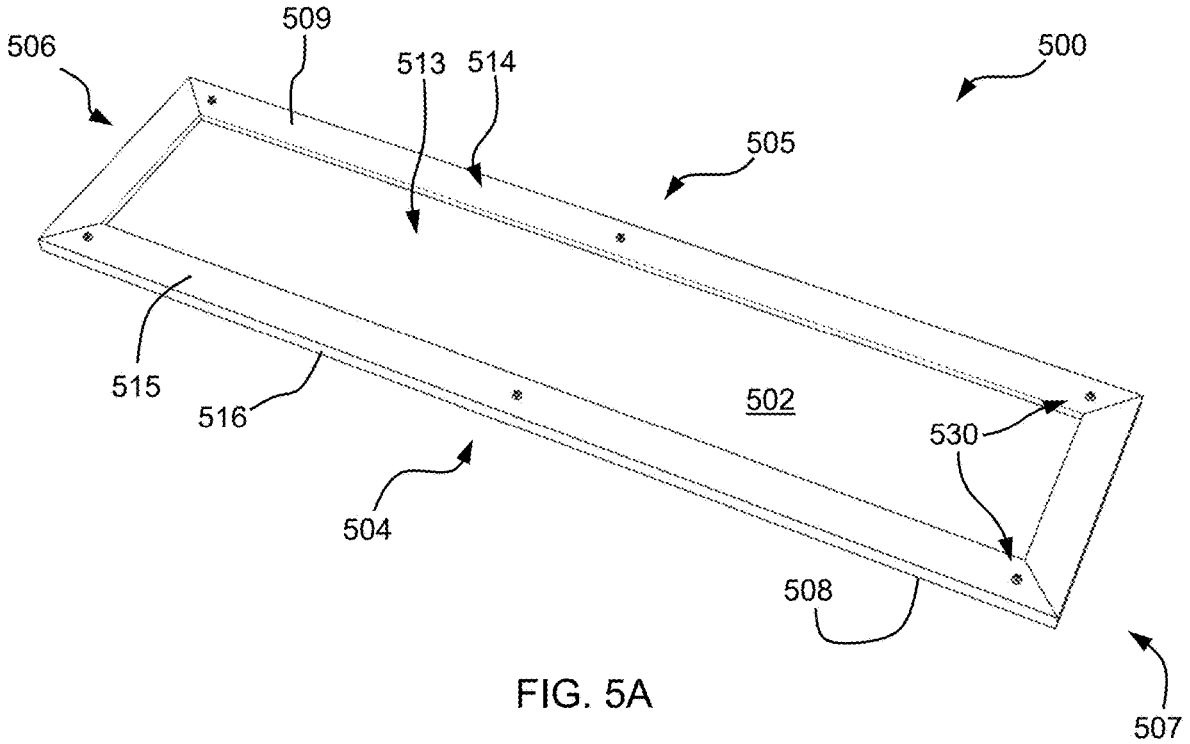
FIG. 5A is a schematic perspective view of a building surface product according to an embodiment of the disclosure.
Figure 5B:
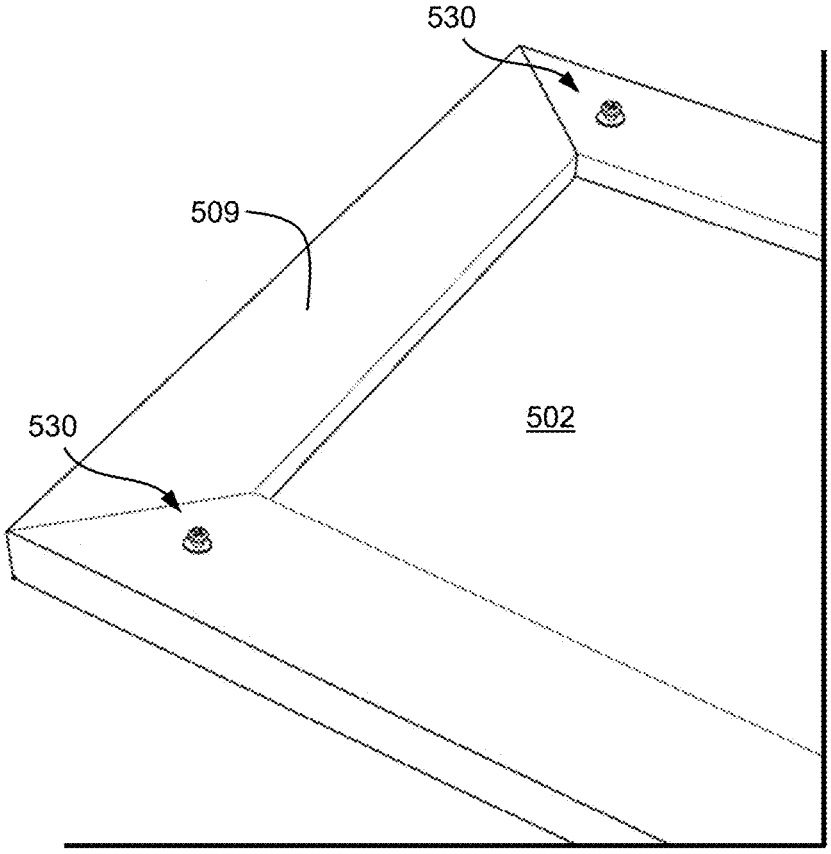
FIG. 5B is a schematic perspective view of a portion of the building surface product of FIG. 5A.
Figure 5C:
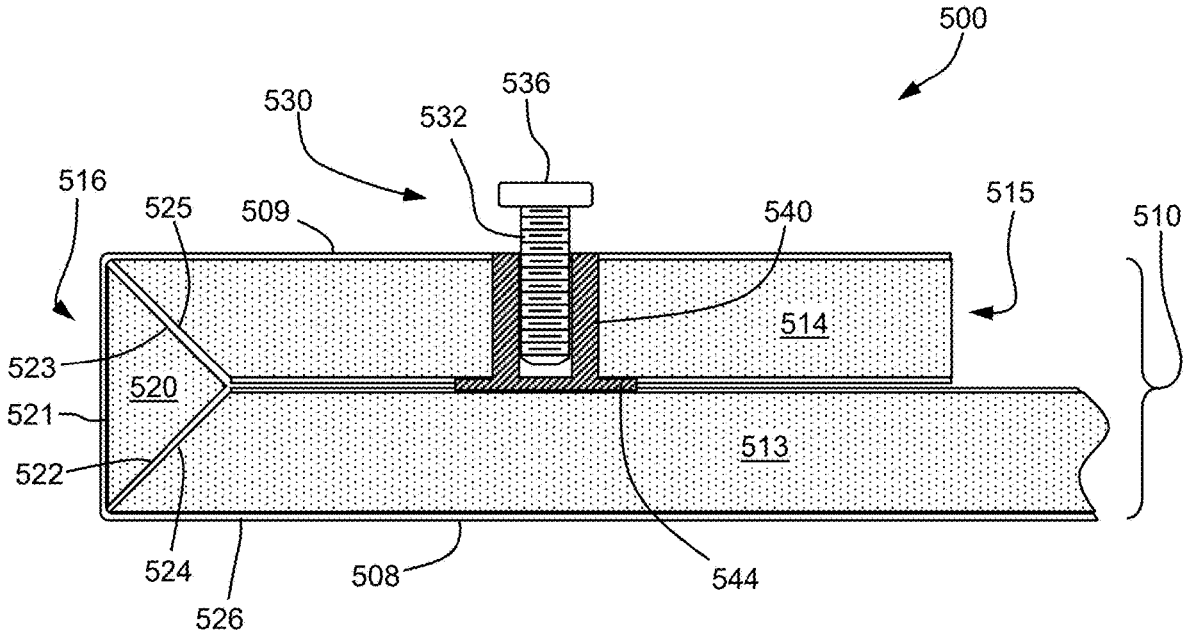
FIG. 5C is a schematic cross-sectional view of a portion of the building surface product of FIG. 5A.
Figure 6:
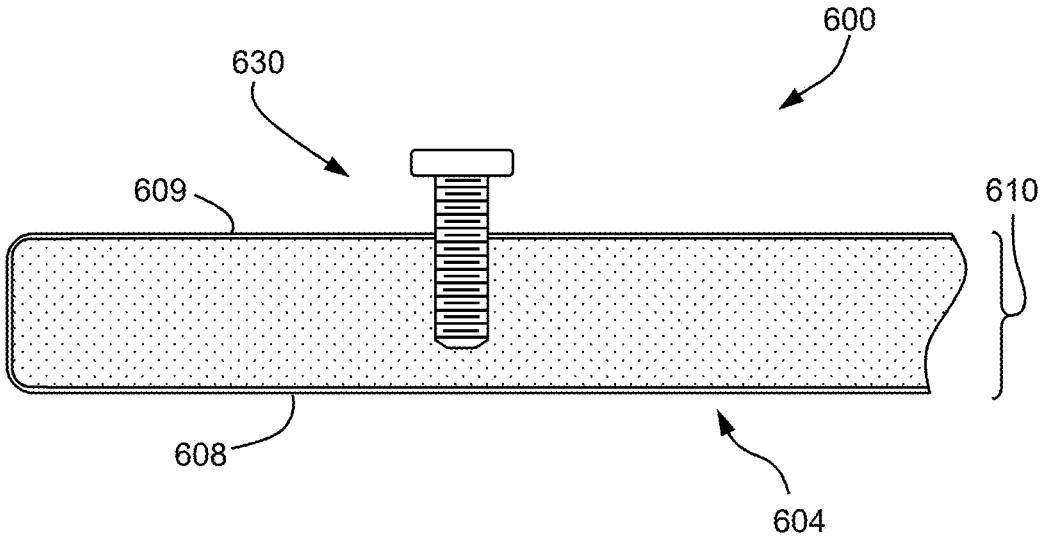
FIG. 6 is a schematic cross-sectional view of a portion of a building surface product according to another embodiment of the disclosure.
Figure 7:
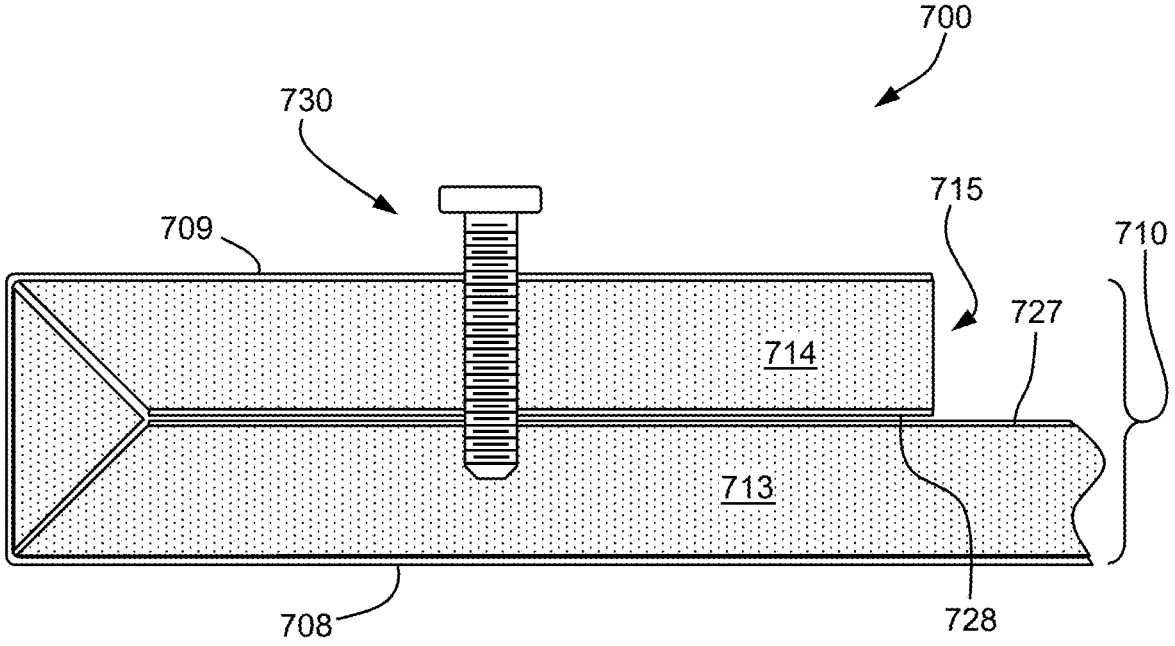
FIG. 7 is a schematic cross-sectional view of a portion of a building surface product according to another embodiment of the disclosure.

FIGS. 5-7 show various embodiments of building surface products used with the building surface system of the disclosure. For example, the rear surface of such a building surface product is shown in perspective view in FIG. 5A. Building surface product 500 includes a planar panel 502 in the form of a rectangle that has a first side 504, a second side 505, a first end 506, a second end 507, a front surface 508, and a rear surface 509. Further, panel 502 includes a gypsum body 510 (see FIG. 5C) that is disposed between the front surface 508 and the rear surface 509. Building surface product 500 also includes a number of attachment posts 530 extending outward from rear surface 509 of panel 502. FIG. 5B shows greater detail of two of the attachment posts 530 extending from rear surface 509 of panel 502, and FIG. 5C shows a cross-sectional view of a first attachment post 530 embedded in the rear surface 509 of panel 502.

As illustrated in FIG. 5C, first attachment post 530 includes a shaft 532 extending outward from rear surface 509 of panel 502 and a head 536 extending radially outward from shaft 532. Head 536 is configured to engage part of a support structure so as to couple building surface product 500 to the support structure, as described above.

In certain embodiments of the building surface system as otherwise described herein, the gypsum body includes a front layer and a reinforcing layer disposed behind the front layer. For example, as shown in FIGS. 5A through 5C, gypsum body 510 of panel 502 includes a front layer 513 that extends across the width and length of panel 502 from first side 504 to second side 505 and from first end 506 to second end 507. In addition, a reinforcing layer 514 extends around the perimeter of panel 502 behind front layer 513. The reinforcing layer 514 provides a greater thickness to gypsum body 510 around the perimeter of panel 502, and may increase the strength of the panel 502.

In other embodiments, the gypsum body of the panel includes a single layer. Such an embodiment is shown in FIG. 6. Panel 602 of building surface product 600 includes a gypsum body 610 having a single layer that extends from the front surface 608 of panel 602 to the rear surface 609 of panel 602. A plurality of attachment posts including a first attachment post 630 extend into rear surface 609 and are configured to secure building surface product 600 to a support structure.

In certain embodiments of the building surface system as otherwise described herein, the panel includes a first receiver sleeve and the first attachment post extends into the first receiver sleeve. For example, panel 502 of FIGS. 5A to 5C includes a first receiver sleeve 540 that is held in gypsum body 510. As shown in FIG. 5C, first attachment post 530 extends into first receiver sleeve 540 from rear surface 509 and is held in place by engaging with first receiver sleeve 540.

In certain embodiments of the building surface system as otherwise described herein, the first receiver sleeve extends through the reinforcing layer to the front layer. For example, in panel 502, as shown in FIG. 5C, first receiver sleeve 540 extends from rear surface 509 entirely through reinforcing layer 514 so as to abut front layer 513. In other embodiments, the first receiver sleeve extends only partially through the reinforcing layer of the panel body. For example, in some embodiments, the first receiver sleeve is position at the rear surface of the panel and does not extend all the way to the front layer. In other embodiments, the first receiver sleeve is positioned at the interface between the front layer and the reinforcing layer and does not extend all the way to the rear surface. Further in some embodiments, the first receiver sleeve extends into the front surface of the panel. For example, in some embodiments, the first receiver sleeve extends at least partially through the reinforcing layer and into the front layer.

In certain embodiments of the building surface system as otherwise described herein, the first receiver sleeve includes a threaded interior surface configured to engage the first attachment post. For example, in some embodiments, the shaft of the first attachment post is threaded and the first receiver sleeve includes a complementary thread to receive the first attachment post. Such a threaded engagement may help secure the first attachment post in the panel. In other embodiments, the first receiver sleeve is configured to capture the first attachment post in another manner. For example, in some embodiments, the shaft of the first attachment post is threaded and the first receiver sleeve has a deformable interior surface. Accordingly, the threaded shaft of the first attachment post can cut into the first receiver sleeve in order to form a secure connection between the first attachment post and first receiver sleeve.

In certain embodiments of the building surface system as otherwise described herein, the first receiver sleeve includes an external flange disposed between the front layer and the reinforcing layer of the panel. For example, first receiver sleeve 540 of building surface product 500 includes an external flange 544 that extends radially outward from an axis of the receiver sleeve. The external flange 544 is positioned between the front layer 513 and the reinforcing layer 514 so as to capture the receiver sleeve in the gypsum body 510 and prevent first receiver sleeve 540 from separating from panel 502.

In other embodiments, the panel is constructed without a receiver sleeve. For example, in some embodiments, the first attachment post extends directly into the material of the gypsum body. A cross section of such an embodiment is shown in FIG. 7. Building surface product 700 includes a panel 702 with a gypsum body 710 formed between front surface 708 and rear surface 709 of panel 702. Gypsum body 710 includes a front layer 713 and a reinforcing layer 714. A first attachment post 730 extends through rear surface 709 of panel 702 to directly engage gypsum body 710.

In certain embodiments of the building surface system as otherwise described herein, the first attachment post extends through the reinforcing layer and into the front layer. For example, as shown in FIG. 7, first attachment post 730 penetrates rear surface 709 of panel 702 and extends entirely through reinforcing layer 714 and into front layer 713. First attachment post 730 extends only partially into front layer 713 and thus, the end of first attachment post 730 is disposed within the front layer 713. Accordingly, first attachment post 730 is not visible on the front surface 708 of panel 702. In other embodiments, the first attachment post extends through both the front layer and the reinforcing layer to the front surface of the panel. Still, in other embodiments, the first attachment post extends only partially through the reinforcing layer and does not extend to the front layer.

In certain embodiments of the building surface system as otherwise described herein, the reinforcing layer includes a first section along a first edge of the panel, and the first section is disposed behind the front layer along the first edge. For example, as shown in FIG. 5A, reinforcing layer 514 of panel 502 includes a first section 515 along a first edge 516 of panel 502. Specifically, first section 515 of reinforcing layer 514 extends along the length of panel 502 from first end 506 to second end 507, thereby reinforcing the entire first side 504 of panel 502. In other embodiments, the first section of the reinforcing layer extends across the width of the panel, rather than the length. Moreover, in some embodiments, the first section of the reinforcing layer extends over only a portion of the respective side or end, rather than over its entirety.

In certain embodiments of the building surface system as otherwise described herein, the gypsum body includes a first edge section between the front layer and the first section of the reinforcing layer at the first edge. For example, as shown in FIG. 5C, gypsum body 510 includes a first edge section 520 that is positioned along first edge 516 of panel 502 between front layer 513 and the first section 515 of reinforcing layer 514. Accordingly, first edge section 520 forms the outer surface of panel 502 along first edge 516.

In certain embodiments of the building surface system as otherwise described herein, the front layer has a first tapered face along the first edge, the first section of the reinforcing layer has a tapered face along the first edge, and the first edge section has a triangular shape including a front face that is adjacent to the first tapered face of the front layer and a rear face that is adjacent to the tapered face of the first section of the reinforcing layer. For example, first edge section 520 of gypsum body 510 has a triangular cross-section with an outer face 521 along first edge 516, a front face 522 that is presented toward front layer 513, and a rear face 523 that is presented toward first section 515 of reinforcing layer 514. To match the shape of first edge section 520, front layer 513 has a first tapered face 524 that is opposes front face 522 of first edge section 520. Likewise, first section 515 of reinforcing layer 514 also has a tapered face 525 that opposes rear face 523 of first edge section 520. In the embodiment of shown in FIGS. 5A-5D, gypsum body 510 has similar edge sections around the rest of the perimeter of panel 502.

In certain embodiments of the building surface system as otherwise described herein, the front layer, the first edge section, and the first section of the reinforcing layer are formed from a machined and folded gypsum sheet. For example, the configuration shown in FIG. 5C is formed by routing two adjacent V-shaped grooves on one face of a gypsum panel. The space between the two grooves is a triangular ridge of gypsum material that forms first edge section 520. The outer sides of the two grooves form the first tapered face 524 of the front layer 513 and the tapered face 525 of the first section 515 of reinforcing layer 514. The first section 515 of reinforcing layer 514 is then folded over front layer 513 so that the tapered faces 524, 525 oppose the front and rear faces 522, 523 of first edge section 520, respectively.

In certain embodiments of the building surface system as otherwise described herein, a continuous facing sheet extends around the first edge so as to cover a rear face of the first section of the reinforcing layer, an outer face of the first edge section, and the front face of the front layer. For example, when the first section 515 of reinforcing layer 514 is folded behind front layer 513, the facing sheet 526 that extended along the original gypsum panel on the face opposite the grooves wraps around the first edge 516 so as to cover the front surface 508 of the gypsum body 510, the outer face 521 of the first edge section 520 and the rear face of the first section 515 of the reinforcing layer 514. In other embodiments, the facing sheet may be applied to the gypsum body after the reinforcing layer is formed over the front layer. Still, in some embodiments, separate facing sheets cover the front layer and reinforcing layer. Further still, in some embodiments, at least some portions of the gypsum body are not covered by a facing sheet.

In certain embodiments of the building surface system as otherwise described herein, an adhesive layer is provided between the first tapered face of the front layer and the front face of the first edge section. Likewise, in certain embodiments, an adhesive layer is provided between the tapered face of the first section of the reinforcing layer and the rear face of the first edge section. For example, in some embodiments, a layer of adhesive may be disposed on either or both of the front face 522 or rear face 523 of first edge section 520 so as to adhere the first edge section 520 to the respective tapered face 524, 525 of the front layer 513 or first section 515 of the reinforcing layer 514. The adhesive layer may help strengthen the edge of the gypsum body 510 and maintain the folded shape of the panel 502.

In certain embodiments of the building surface system as otherwise described herein, an adhesive layer is provided between the between the front layer and the first section of the reinforcing layer. For example, in some embodiments, a layer of adhesive may be disposed on the rear face of the front layer 513 of gypsum body 510 and on the front face of first section 515 of reinforcing layer 514. The adhesive layer may help hold the first section 515 of reinforcing layer 514 against front layer 513 and strengthen the edge of panel 502. In some embodiments, the layer of adhesive is a continuous layer that extends across the entire front surface of the reinforcing layer. In other embodiments, the layer of adhesive may be formed by spots or traces of adhesive on the faces between the two layers. Still, in other embodiments, the layers may be attached to one another in another manner, such as bonding of the gypsum material of the layers to each other or to a material sheet between the two layers.

In certain embodiments of the building surface system as otherwise described herein, the first attachment post extends through the adhesive layer provided between the front layer and the first section of the reinforcing layer. For example, in some embodiments, the first attachment post may pass through the interface between the front layer and the first section of the reinforcing layer in an area where adhesive is provided between these layers. In some embodiments, the engagement of the first attachment post to the panel may be strengthened by the extension of the first attachment post through the adhesive. On the other hand, in some embodiments, the first attachment post extends through the interface between the front layer and the first section of the reinforcing layer in an area where there is no adhesive positioned between the two layers of the gypsum body.

In certain embodiments of the building surface system as otherwise described herein, a pair of facing sheets are provided between the front layer and the first section of the reinforcing layer. For example, in gypsum body 710 of panel 702 a first intermediate facing sheet 727 is secured to the rear face of front layer 713 and a second intermediate facing sheet 728 is secured to the front face of first section 715 of reinforcing layer 714. Each of the intermediate facing sheets 727, 728 can help increase the strength of the corresponding layer 713, 714 of gypsum body 710. Moreover, the intermediate facing sheets 727, 728 may also help secure the first attachment post 730 in the gypsum body 710.

In certain embodiments of the building surface system as otherwise described herein, the reinforcing layer extends around a perimeter of the panel. For example, in certain embodiments, the reinforcing layer includes a section along each edge of the panel. Moreover, in some embodiments, the gypsum body includes an edge section along each edge of the panel between the front layer and respective section of the reinforcing layer. For example, as shown in FIG. 5A, reinforcing layer 514 of panel 502 is formed by four sections positioned around the perimeter of the panel. The four sections of reinforcing layer 514 cooperate using miter joints to form a frame around the perimeter of panel 502. In other embodiments, the reinforcing layer is formed by another number of sections. For example, in some embodiments, the reinforcing layer is formed by two sections along the sides or ends of the panel. In other embodiments, the reinforcing layer is formed by more sections. Further, in some embodiments, the reinforcing layer is formed by a single section that is folded behind the reinforcing layer. For example, in some embodiments, the reinforcing layer is formed by a single section that extends over the entire front layer of the panel.

In certain embodiments of the building surface system as otherwise described herein, the first attachment post is one of a plurality of attachment posts extending from the rear surface of the panel. For example, building surface product 500 includes four attachment posts 530 extending from the rear surface 509 of panel 502. Further, in some embodiments, all of the attachment posts have the same configuration, such as in building surface product 500. For example, in some embodiments, each of the plurality of attachment posts includes a shaft having a first end that penetrates the rear surface of the panel and a head positioned at a second end of the shaft that is spaced from the panel.

In other embodiments, the attachment posts have different configurations. For example, in some embodiments, the attachment posts at one end of the panel have a different configuration than attachment posts at the other end. Likewise, in some embodiments, the attachment posts at the top of the panel have a different configuration than those at the bottom. Further, while building surface product 500 includes four attachment posts 530, as shown in FIG. 5A, in other embodiments, the building surface product may include more or fewer attachment posts. For example, in some embodiments, the building surface product includes several columns of attachment posts across the width of the panel. Likewise, in some embodiments, the building surface product includes several rows of attachment posts over the height of the panel. Further, in some embodiments, the building surface product includes attachment posts along only one side of the panel, while the other side of the panel is secured in another manner. Further still, in some embodiments, the building surface product includes a single attachment post.

In some embodiments, the panel includes a gypsum body. In other embodiments, the panel is formed from another material. For example, in some embodiments, the panel includes a body that is constructed of wood, a fibrous material, a cementitious material, a polymer material, such as a polymer foam, or combinations thereof. Further, such materials may be organic or inorganic. Moreover, the panels may include natural and renewable materials, such as plant fibers, animal fibers, or mineral fibers. In some embodiments, building surface products including a panel of the aforementioned materials may include attachment posts that are fastened to the rear surface of the panel with or without passing all the way through the panel.

In certain embodiments of the building surface system as otherwise described herein, the gypsum body comprises a reinforced gypsum material. The use of a reinforced gypsum material can enhance the connection between the panel and the attachment posts that are attached to the panel. Moreover, the use of a reinforced gypsum material can also provide extra stability for the panel in the vicinity of the attachment posts. For example, in some embodiments, the gypsum body includes at least 1% by weight polymer. Reference to the weight percentage of a component of the gypsum body, as used herein, refers to the weight after the gypsum has set. In certain embodiments, the polymer includes starch and/or polyvinyl acetate.

In certain embodiments of the building surface system as otherwise described herein, the gypsum body includes at least 1% by weight of reinforcing fibers. For example, in some embodiments, the gypsum body includes glass fibers. Further, in some embodiments, the gypsum panel includes cellulose-based fibers. Moreover, in some embodiments, the gypsum panel includes polyethylene, polypropylene or polyester fibers. Various embodiments of the building surface product include different combinations of the aforementioned fibers in the gypsum panel.

In some embodiments, the gypsum body includes one or more additives, such as biocides, hydrophobic additives, and fire resistance additives.

In certain embodiments of the building surface system as otherwise described herein, the panel is rectangular. For example, as shown in FIG. 5A, the shape of building surface product 500 is governed by panel 502 which has a rectangular form. In particular, the first edge 516 along first side 504 is parallel to the edge along second side 505 and the two edges run across the width of panel 502. Likewise, the edge at first end 506 is parallel to edge at second end 507. Moreover, the sides and ends of panel 502 are perpendicular to one another such that the shape of panel 502 is that of a rectangle. In other embodiments, the building surface product has another shape. For example, in some embodiments, the building surface product is formed as a trapezoid, triangle, or other polygon.

In some embodiments the building surface product is configured to form a wall surface or ceiling surface. For example, panel 502 of building surface product 500 is a wall panel. In other embodiments, the building surface product is configured to form a trim or decorative element. For example, in some embodiments, the panel of the building surface product is formed as a trim or decorative component that is attached to a support structure using the attachment posts of the disclosure. For example, in some embodiments the panel is a molding component, such as crown molding at the top of the building surface. In other embodiments, the panel forms a baseboard at the bottom of a building surface. Still in other embodiments, the panel forms corner trim or window trim. Various shapes for such trim configurations are possible. For example, in some embodiments, the trim may be flat, angled or curved. Likewise, such trim can be proud, flush or recessed. Still, in other embodiments the building surface product forms a decorative beam. In some embodiments, the building surface product passes over the middle of a building surface. For example, in some embodiments, the panel of the building surface product forms a chair rail, a batten or has another configuration that passes over the middle of the surface. In some embodiments, the building surface product includes a panel configured as a trim or decorative element and is formed of a polymer or wood and the first attachment post extends only partially through the panel.

In certain embodiments of the building surface system as otherwise described herein, the building surface product further includes a facing sheet that lines the gypsum body along at least one of the front surface and the rear surface. In some embodiments, the facing sheet is a paper facing. In other embodiments, the facing sheet includes reinforcing fibers. For example, in some embodiments, the facing sheet includes a fiberglass mat. Further, in some embodiments, the gypsum material is embedded into the facing sheet.

In certain embodiments of the building surface system as otherwise described herein, the facing sheet surrounds the panel along its length covering both the front surface and the rear surface. For example, in some embodiments, the facing sheet is formed from two distinct sheets that are wrapped around the gypsum panel. The facing sheets may then be attached to one another to surround the panel. In some embodiments, the facing sheets wrap around the panel along its length. The ends of the panel may then either be left uncovered or the facing sheets may also be folded over the ends.

In certain embodiments of the building surface system as otherwise described herein, a width of the panel from the first side to the second side is at least 3 inches, e.g., at least 4 inches, e.g., at least 6 inches. In some embodiments, the width of the panel from the first side to the second side is no more than 6 feet, e.g., no more than 4 feet, e.g., no more than 3 feet. For example, in some embodiments, the width of the panel is in a range from 3 inches to 6 feet, e.g., from 4 inches to 4 feet, e.g., from 6 inches to 3 feet.

In certain embodiments of the building surface system as otherwise described herein, a length of the panel from the first end to the second end is at least 1 foot, e.g., at least 2 feet, e.g., at least 4 feet. In some embodiments, the length of the panel from the first end to the second end is no more than 20 feet, e.g., no more than 15 feet, e.g., no more than 12 feet. For example, in some embodiments, the length of the panel is in a range from 1 foot to 20 feet, e.g., from 2 feet to 15 feet, e.g., from 4 feet to 12 feet.

In certain embodiments of the building surface system as otherwise described herein, a thickness of the panel is at least ⅜ inch, e.g., at least ½ inch, e.g., at least ¾ inch. In some embodiments, the thickness of the panel is no more than 4 inches, e.g., no more than 3 inches, e.g., no more than 2 inches. For example, in some embodiments, the thickness of the panel is in a range from ⅜ inch to 4 inches, e.g., from ½ inch to 3 inches, e.g., from ¾ inch to 2 inches.

In another aspect, the disclosure provides a method of forming the building surface system according to the disclosure. The method includes positioning the first building surface product in front of the support structure such that the rear surface of the panel of the first building surface product faces the support structure, a shaft of the first attachment post extends through the vertical receiving slot of the longitudinal section of the first vertical rail, and the head of the first attachment post is positioned behind the first vertical rail. The first building surface product is secured to the support structure by reducing the distance between the head of the first attachment post and the rear surface of the panel so as to clamp the first vertical rail between the head of the first attachment post and the rear surface of the panel.

For example, with reference to FIG. 1C, to secure the first building surface product 100 to the support structure, the building surface product 100 is placed in front of the vertical rail 160 of the support structure with the rear surface 109 of the panel 102 of the first building surface product 100 facing the vertical rail 160. Further, attachment posts 130 extending from the rear surface 109 of the panel 102 are positioned in the vertical receiving slot 170 of the vertical rail 160. The building surface product 100 is then secured by adjusting the distance between the head 136 of the attachment posts 130 and the rear surface 109 of the panel 102 to clamp the vertical rail 160 therebetween.

In certain embodiments of the method as otherwise described herein, the shaft of the first attachment post is threaded and reducing the distance between the head of the first attachment post and the rear surface of the panel includes rotating the head of the first attachment post. For example, in some embodiments, the shaft and head of the attachment post are formed in an integral piece, such as a bolt, and rotating the head of the attachment posts causes the shaft of the attachment post to move into or out of the panel. In other embodiments, the head is threaded and engages the threads of the shaft. Accordingly, the position of the shaft may be fixed with respect to the panel and the rotation of the head can move the head toward or away from the panel.

In certain embodiments of the method as otherwise described herein, the first building surface product is positioned in front of the support structure such that a plurality of additional attachment posts of the first building surface product are inserted in respective receiving slots of the support structure, and each of the attachment posts is then tightened to clamp the vertical rail between the head of the respective attachment post and the respective vertical rail of the support structure. For example, in building surface system 150, shown in FIG. 1A, each of the building surface products 100 is attached to the support structure 152 with attachment posts that extend through each of the vertical rails 160.

In certain embodiments of the method as otherwise described herein, the method further includes positioning a second first building surface product in front of the support structure and adjacent to the first building surface product such that a rear surface of a panel of the second building surface product faces the support structure, a shaft of a first attachment post of the second building surface product extends through the vertical receiving slot of the longitudinal section of the first vertical rail, and a head of the first attachment post of the second building surface product is positioned behind the first vertical rail. The second building surface product is secured to the support structure by reducing the distance between the head of the first attachment post of the second building surface product and the rear surface of the panel so as to clamp the first vertical rail between the head of the first attachment post of the second building surface product and the rear surface of the panel. For example, second building surface product 101 shown in FIGS. 1B, 1C and 1E is secured to vertical rail 160 in a similar manner as first building surface product 100 using attachment posts 130 that extend through vertical receiving slot 170 and clamp the vertical rail 160 between the respective heads of the attachment posts and the panel of the second building surface product 101.

In certain embodiments of the method as otherwise described herein, the method includes positioning a spacer between a first side of the first building surface product and a second side of the second building surface product before securing the second building surface product to the support structure. For example, as shown in the exploded view of FIG. 1E, a spacer 190 may be positioned between the edge at the upper side 105 of the second building surface product 101 and the edge at the lower side 104 of the first building surface product 100 to aid in positioning the first building surface product 100. The spacer can assist in providing a uniform spacing between the first building surface product 100 and the second building surface product 101 before the attachment posts 130 of the first building surface product 100 are locked in place. Once the first building surface product 100 is in the desired position, the attachment posts 130 can be tightened to secure the first building surface product 100 in the appropriate position.

In some embodiments of the method, the spacers are removed after the building surface products are secured to the support structure. In other embodiments, the spacers are retained and form part of the building surface structure. For example, in some embodiments, the spacers provide a decorative element between the building surface products, such as an accent line.

In some embodiments, the support structure is assembled first and the building surface products are secured to the assembled support structure. For example, in some embodiments, the vertical rails are initially attached to framing members and then the building surface products are attached to the vertical rails. In other embodiments, the building surface products and vertical rails may be attached to the framing elements in an assembly. For example, in building surface system 250, shown in FIGS. 2A and 2B, each of the building surface products 200 may be coupled to respective vertical rails 260 that are secured to the framing members 254 as an assembly. For example, with the attachment posts 230 of a building surface product 200 extending through a respective vertical rail 260, the vertical rail 260 and building surface product 200 may be positioned against the framing member 254. The building surface product 200 can then be raised to expose the fastening hole 266 at the lower end of the vertical rail 260. A fastener may then be inserted through fastening hole 266 to secure the lower end of the vertical rail 260 to the framing member 254. Once the lower end of the vertical rail 260 is secured, the building surface product 200 can be lowered to expose the fastening hole 268 at the upper end of the vertical rail 260. The upper end of the vertical rail 260 can then be secured to the framing member using another fastener through fastener hole 268. With the vertical rail 260 secured to the framing member, the position of the building surface product 200 can be set by tightening the attachment posts.

Various aspects and embodiments of the disclosure are provided by the following enumerated embodiments, which may be combined in any number and in any combination not logically or technically inconsistent.

Embodiment 1. A building surface system comprising:

a support structure including a plurality of vertical rails that form a support surface, wherein the plurality of vertical rails comprises a first vertical rail including a longitudinal section and a vertical receiving slot in the longitudinal section; and a plurality of building surface products attached to the support structure, wherein the plurality of building surface products comprises a first building surface product including:

a substantially planar panel having a first side, a second side, a first end, a second end, a front surface, a rear surface, and a gypsum body between the front surface and rear surface, and a first attachment post extending outward from the rear surface of the panel, the first attachment post including a shaft that penetrates the rear surface of the panel and a head that extends radially outward from the shaft at a distance from the rear surface of the panel, wherein the distance between the head and the rear surface of the panel is adjustable wherein the shaft of the first attachment post of the first building surface product extends through the vertical receiving slot of the first vertical rail and the longitudinal section of the first vertical rail is clamped between the head of the first attachment post and the rear surface of the panel so as to secure the first building surface product against the support structure Embodiment 2. The building surface system according to embodiment 1, wherein the shaft of the first attachment post is unsupported by the first vertical rail.

Embodiment 3. The building surface system according to embodiment 1 or embodiment 2, wherein the vertical receiving slot intersects a first opening, and wherein the first attachment post is insertable into the vertical receiving slot through the first opening.

Embodiment 4. The building surface system according to embodiment 3, wherein the first opening is formed as an aperture in the longitudinal section of the first rail, and wherein the aperture has a width that is greater than a width of the vertical receiving slot.

Embodiment 5. The building surface system according to 4, wherein the first building surface product includes a second attachment post extending outward from the rear surface of the panel, and wherein the vertical receiving slot intersects a second opening, and wherein the second attachment post is insertable into the vertical receiving slot through the second opening.

Embodiment 6. The building surface system according to embodiment 5, wherein a distance between the first attachment post and the second attachment post is the same as the distance between the first opening and the second opening.

Embodiment 7. The building surface system according to embodiment 3, wherein the first opening is formed at an edge of the first vertical rail.

Embodiment 8. The building surface system according to any of embodiments 1 to 7, wherein the first vertical rail is configured as a flat plate.

Embodiment 9. The building surface system according to any of embodiments 1 to 8, wherein the support structure includes a plurality of framing members comprising a first framing member, and wherein the first vertical rail includes a mounting section attached to the first framing member.

Embodiment 10. The building surface system according to embodiment 9, wherein the mounting section includes a hole and is attached to the first framing member using a fastener that extends through the hole.

Embodiment 11. The building surface system according to any of embodiments 1 to 10, wherein the rear surface of the panel of the first building surface product abuts a front surface of the first vertical rail.

Embodiment 12. The building surface system according to embodiment 11, wherein the longitudinal section of the first vertical rail forms at least a portion of the front surface of the first vertical rail.

Embodiment 13. The building surface system according to any of embodiments 1 to 12, wherein the plurality of building surface products includes a second building surface product adjacent to the first building surface product, and wherein an attachment post of the second building surface product is received in the vertical receiving slot of the longitudinal section of the first vertical rail so as to secure the second building surface product against the support structure.

Embodiment 14. The building surface system according to embodiment 13, further comprising a spacer positioned between a first side of a panel of the second building surface product and the second side of the panel of the first building surface product.

Embodiment 15. The building surface system according to any of embodiments 1 to 14, wherein the receiving slot of the first vertical rail includes a plurality of slot segments extending in a line along the longitudinal section.

Embodiment 16. The building surface system according to any of embodiments 1 to 15, wherein the first vertical rail is one of a column of vertical rails of the plurality of vertical rails.

Embodiment 17. The building surface system according to any of embodiments 1 to 16, wherein each of the vertical rails includes at least one vertical receiving slot, wherein each of the building surface products includes a plurality of attachment posts, and wherein each of the building surface products is secured to a portion of the vertical rails through engagement of the attachment posts with the vertical receiving slots.

Embodiment 18. The building surface system according to any of embodiments 1 to 17, wherein the gypsum body of the first building surface product includes a front layer and a reinforcing layer disposed behind the front layer, wherein the first attachment post extends at least partially through the reinforcing layer.

Embodiment 19. The building surface system according to embodiment 18, wherein the reinforcing layer includes a first section along a first edge of the panel, and wherein the first section is disposed behind the front layer along the first edge.

Embodiment 20. The building surface system according to embodiment 19, wherein the gypsum body includes a first edge section between the front layer and the first section of the reinforcing layer at the first edge.

Embodiment 21. The building surface system according to embodiment 20, wherein the front layer has a first tapered face along the first edge, the first section of the reinforcing layer has a tapered face along the first edge, and the first edge section has a triangular shape including a front face that is adjacent to the first tapered face of the front layer and a rear face that is adjacent to the tapered face of the first section of the reinforcing layer.

Embodiment 22. The building surface system according to embodiment 20 or embodiment 21 wherein the front layer, the first edge section, and the first section of the reinforcing layer are formed from a machined and folded gypsum sheet.

Embodiment 23. The building surface system according to any of embodiments 20 to 22, wherein a continuous facing sheet extends around the first edge so as to cover a rear face of the first section of the reinforcing layer, an outer face of the first edge section, and the front face of the front layer.

Embodiment 24. The building surface system according to any of embodiments 21 to 23, wherein an adhesive layer is provided between the first tapered face of the front layer and the front face of the first edge section.

Embodiment 25. The building surface system according to any of embodiments 21 to 24, wherein an adhesive layer is provided between the tapered face of the first section of the reinforcing layer and the rear face of the first edge section.

Embodiment 26. The building surface system according to any of embodiments 20 to 25, wherein an adhesive layer is provided between the front layer and the first section of the reinforcing layer.

Embodiment 27. The building surface system according to embodiment 26, wherein the shaft of the first attachment post extends through the adhesive layer provided between the front layer and the first section of the reinforcing layer.

Embodiment 28. The building surface system according to any of embodiments 20 to 27, wherein a pair of facing sheets is provided between the front layer and the first section of the reinforcing layer.

Embodiment 29. The building surface system according to any of embodiments 18 to 28, wherein the reinforcing layer extends around a perimeter of the panel.

Embodiment 30. The building surface system according to any of embodiments 18 to 29, wherein the reinforcing layer includes a section along each edge of the panel.

Embodiment 31. The building surface system according to embodiment 30, wherein the gypsum body includes an edge section along each edge of the panel between the front layer and respective section of the reinforcing layer.

Embodiment 32. The building surface system according to any of embodiments 1 to 31, wherein the panel of the first building surface product includes a first receiver sleeve and the shaft of the first attachment post extends into the first receiver sleeve.

Embodiment 33. The building surface system according to embodiment 32, wherein the first receiver sleeve extends through the reinforcing layer.

Embodiment 34. The building surface system according to embodiment 32 or embodiment 33, wherein the first receiver sleeve includes a threaded interior surface configured to engage the shaft of the first attachment post.

Embodiment 35. The building surface system according to any of embodiments 32 to 34, wherein the first receiver sleeve includes an external flange disposed between the front layer and the reinforcing layer.

Embodiment 36. The building surface system according to any of embodiments 1 to 35, wherein at least a portion of the shaft of the first attachment post is threaded.

Embodiment 37. The building surface system according to embodiment 36, wherein the head and the shaft of the first attachment post are integrally formed in a single piece.

Embodiment 38. The building surface system according to embodiment 36, wherein the head of the first attachment post engages the threads on the shaft, and wherein the position of the head on the shaft is adjustable.

Embodiment 39. The building surface system according to any of embodiments 1 to 38, wherein the gypsum body comprises a reinforced gypsum material.

Embodiment 40. The building surface system according to any of embodiments 1 to 39, wherein the gypsum body includes at least 1% by weight polymer.

Embodiment The building surface system according to embodiment 40, wherein the polymer includes starch and/or polyvinyl acetate.

Embodiment 42. The building surface product according to any of embodiments 1 to 41, wherein the gypsum body includes at least 1% by weight of reinforcing fibers.

Embodiment 43. The building surface system according to any of embodiments 1 to 42, further comprising a facing sheet that lines the gypsum body along at least one of the front surface and the rear surface.

Embodiment 44. The building surface system according to embodiment 43, wherein the facing sheet is a paper facing.

Embodiment 45. The building surface system according to any of embodiments 1 to 44, wherein a width of the panel from the first side to the second side is at least 3 inches, e.g., at least 4 inches, e.g., at least 6 inches.

Embodiment 46. The building surface product according to any of embodiments 1 to 45, wherein a width of the panel from the first side to the second side is no more than 6 feet, e.g., no more than 4 feet, e.g., no more than 3 feet.

Embodiment 47. The building surface product according to any of embodiments 1 to 46, wherein a length of the panel from the first end to the second end is at least 1 foot, e.g., at least 2 feet, e.g., at least 4 feet.

Embodiment 48. The building surface product according to any of embodiments 1 to 47, wherein a length of the panel from the first end to the second end is no more than 20 feet, e.g., no more than 15 feet, e.g., no more than 12 feet.

Embodiment 49. The building surface product according to any of embodiments 1 to 47, wherein a thickness of the panel is at least ⅜ inch, e.g., at least ½ inch, e.g., at least ¾ inch.

Embodiment 50. The building surface product according to any of embodiments 1 to 49, wherein a thickness of the panel is no more than 4 inches, e.g., no more than 3 inches, e.g., no more than 2 inches.

Embodiment 51. A method of forming the building surface system according to any of embodiments 1 to 50, the method comprising:

positioning the first building surface product in front of the support structure such that the rear surface of the panel of the first building surface product faces the support structure, a shaft of the first attachment post extends through the vertical receiving slot of the longitudinal section of the first vertical rail, and the head of the first attachment post is positioned behind the first vertical rail; and securing the first building surface product to the support structure by reducing the distance between the head of the first attachment post and the rear surface of the panel so as to clamp the first vertical rail between the head of the first attachment post and the rear surface of the panel.

Embodiment 52. The method of embodiment 51, wherein the shaft of the first attachment post is threaded and reducing the distance between the head of the first attachment post and the rear surface of the panel includes rotating the head of the first attachment post.

Embodiment 53. The method of embodiment 51 or embodiment 52, further comprising:

positioning a second first building surface product in front of the support structure and adjacent to the first building surface product such that a rear surface of a panel of the second building surface product faces the support structure, a shaft of a first attachment post of the second building surface product extends through the vertical receiving slot of the longitudinal section of the first vertical rail, and a head of the first attachment post of the second building surface product is positioned behind the first vertical rail; and securing the second building surface product to the support structure by reducing the distance between the head of the first attachment post of the second building surface product and the rear surface of the panel so as to clamp the first vertical rail between the head of the first attachment post of the second building surface product and the rear surface of the panel.

Embodiment 54. The method according to embodiment 53, further comprising positioning a spacer between a first side of the first building surface product and a second side of the second building surface product before securing the second building surface product to the support structure.

Embodiment 55. The method according to embodiment 54, further comprising removing the spacer.

Embodiment 56. The method according to embodiment 51 or embodiment 52, further comprising, before securing the first building surface product to the support structure, securing a first end of the vertical rail to a framing member, sliding the first building surface product so as to expose a second end of the vertical rail, and securing the second end of the vertical rail to the framing member.

It will be apparent to those skilled in the art that various modifications and variations can be made to the processes and devices described here without departing from the scope of the disclosure. Thus, it is intended that the present disclosure cover such modifications and variations of this invention provided they come within the scope of the appended claims and their equivalents.

What is claimed is:

1. A building surface system comprising:

a support structure including a plurality of vertical rails that form a support surface, wherein the plurality of vertical rails comprises a first vertical rail including a longitudinal section and a vertical receiving slot in the longitudinal section; and a plurality of building surface products attached to the support structure, wherein the plurality of building surface products comprises a first building surface product including:

a substantially planar panel having a first side, a second side, a first end, a second end, a front surface, a rear surface, and a gypsum body between the front surface and rear surface, and a first attachment post extending outward from the rear surface of the panel, the first attachment post including a shaft that penetrates the rear surface of the panel and a head that extends radially outward from the shaft at a distance from the rear surface of the panel, wherein the distance between the head and the rear surface of the panel is adjustable wherein the shaft of the first attachment post of the first building surface product extends through the vertical receiving slot of the first vertical rail and the longitudinal section of the first vertical rail is clamped between the head of the first attachment post and the rear surface of the panel so as to secure the first building surface product against the support structure, wherein the shaft of the first attachment post is unsupported by a bottom of the vertical receiving slot of the first vertical rail.

2. The building surface system according to claim 1, wherein the vertical receiving slot intersects a first opening, and wherein the first attachment post is insertable into the vertical receiving slot through the first opening.

3. The building surface system according to claim 2, wherein the first opening is formed as an aperture in the longitudinal section of the first rail, and wherein the aperture has a width that is greater than a width of the vertical receiving slot.

4. The building surface system according to claim 3, wherein the first building surface product includes a second attachment post extending outward from the rear surface of the panel, and wherein the vertical receiving slot intersects a second opening, and wherein the second attachment post is insertable into the vertical receiving slot through the second opening.

5. The building surface system according to claim 1, wherein the first vertical rail is configured as a flat plate.

6. The building surface system according to claim 1, wherein the support structure includes a plurality of framing members comprising a first framing member, and wherein the first vertical rail includes a mounting section attached to the first framing member.

7. The building surface system according to claim 1, wherein the rear surface of the panel of the first building surface product abuts a front surface of the first vertical rail.

8. The building surface system according to claim 1, wherein the plurality of building surface products includes a second building surface product adjacent to the first building surface product, and wherein an attachment post of the second building surface product is received in the vertical receiving slot of the longitudinal section of the first vertical rail so as to secure the second building surface product against the support structure.

9. The building surface system according to claim 1, wherein the vertical receiving slot of the first vertical rail includes a plurality of slot segments extending in a line along the longitudinal section.

10. The building surface system according to claim 1, wherein the first vertical rail is one of a column of vertical rails of the plurality of vertical rails.

11. The building surface system according to claim 1, wherein each of the vertical rails includes at least one vertical receiving slot, wherein each of the building surface products includes a plurality of attachment posts, and wherein each of the building surface products is secured to a portion of the vertical rails through engagement of the attachment posts with the vertical receiving slots.

12. The building surface system according to claim 1, wherein the gypsum body of the first building surface product includes a front layer and a reinforcing layer disposed behind the front layer, wherein the first attachment post extends at least partially through the reinforcing layer.

13. The building surface system according to claim 12, wherein the reinforcing layer includes a first section along a first edge of the panel, and wherein the first section is disposed behind the front layer along the first edge;

the gypsum body includes a first edge section between the front layer and the first section of the reinforcing layer at the first edge; and the front layer has a first tapered face along the first edge, the first section of the reinforcing layer has a tapered face along the first edge, and the first edge section has a triangular shape including a front face that is adjacent to the first tapered face of the front layer and a rear face that is adjacent to the tapered face of the first section of the reinforcing layer.

14. The building surface system according to claim 12, wherein the reinforcing layer includes a section along each edge of the panel.

15. The building surface system according to claim 1, wherein the panel of the first building surface product includes a first receiver sleeve and the shaft of the first attachment post extends into the first receiver sleeve.

16. The building surface system according to claim 1, wherein at least a portion of the shaft of the first attachment post is threaded.

17. A method of forming a building surface system comprising:

a support structure including a plurality of vertical rails that form a support surface, wherein the plurality of vertical rails comprises a first vertical rail including a longitudinal section and a vertical receiving slot in the longitudinal section; and a plurality of building surface products attached to the support structure, wherein the plurality of building surface products comprises a first building surface product including:

a substantially planar panel having a first side, a second side, a first end, a second end, a front surface, a rear surface, and a gypsum body between the front surface and rear surface, and a first attachment post extending outward from the rear surface of the panel, the first attachment post including a shaft that penetrates the rear surface of the panel and a head that extends radially outward from the shaft at a distance from the rear surface of the panel, wherein the distance between the head and the rear surface of the panel is adjustable wherein the shaft of the first attachment post of the first building surface product extends through the vertical receiving slot of the first vertical rail and the longitudinal section of the first vertical rail is clamped between the head of the first attachment post and the rear surface of the panel so as to secure the first building surface product against the support structure, the method comprising:

positioning the first building surface product in front of the support structure such that the rear surface of the panel of the first building surface product faces the support structure, a shaft of the first attachment post extends through the vertical receiving slot of the longitudinal section of the first vertical rail, and the head of the first attachment post is positioned behind the first vertical rail; and securing the first building surface product to the support structure by reducing the distance between the head of the first attachment post and the rear surface of the panel so as to clamp the first vertical rail between the head of the first attachment post and the rear surface of the panel.

18. The method according to claim 17, wherein the shaft of the first attachment post is unsupported by a bottom of the vertical receiving slot of the first vertical rail.

19. The building surface system according to claim 17, wherein the receiving slot of the first vertical rail includes a plurality of slot segments extending in a line along the longitudinal section.

20. A building surface system comprising:

a support structure including a plurality of vertical rails that form a support surface, wherein the plurality of vertical rails comprises a first vertical rail including a longitudinal section and a vertical receiving slot in the longitudinal section; and a plurality of building surface products attached to the support structure, wherein the plurality of building surface products comprises a first building surface product including:

a substantially planar panel having a first side, a second side, a first end, a second end, a front surface, a rear surface, and a gypsum body between the front surface and rear surface, and a first attachment post extending outward from the rear surface of the panel, the first attachment post including a shaft that penetrates the rear surface of the panel and a head that extends radially outward from the shaft at a distance from the rear surface of the panel, wherein the distance between the head and the rear surface of the panel is adjustable wherein the shaft of the first attachment post of the first building surface product extends through the vertical receiving slot of the first vertical rail and the longitudinal section of the first vertical rail is clamped between the head of the first attachment post and the rear surface of the panel so as to secure the first building surface product against the support structure, wherein the plurality of building surface products includes a second building surface product adjacent to the first building surface product, and wherein an attachment post of the second building surface product is received in the vertical receiving slot of the longitudinal section of the first vertical rail so as to secure the second building surface product against the support structure.

* * * * *